US006798501B1

(12) United States Patent
Mizuno

(10) Patent No.: US 6,798,501 B1
(45) Date of Patent: Sep. 28, 2004

(54) CUP ATTACHING APPARATUS

(75) Inventor: Toshiaki Mizuno, Aichi (JP)

(73) Assignee: Nidek Co., Ltd., Aichi (JP)

( * ) Notice: Subject to any disclaimer, the term of this patent is extended or adjusted under 35 U.S.C. 154(b) by 609 days.

(21) Appl. No.: 09/652,041

(22) Filed: Aug. 31, 2000

Related U.S. Application Data

(63) Continuation-in-part of application No. 09/239,317, filed on Jan. 29, 1999.

(30) Foreign Application Priority Data

Jan. 30, 1998 (JP) ..... 10-034035
Aug. 31, 1998 (JP) ..... 10-246213
Aug. 31, 1999 (JP) ..... 11-244333

(51) Int. Cl.[7] ..... G01B 9/00
(52) U.S. Cl. ..... 356/124; 356/125; 356/127
(58) Field of Search ..... 356/124, 125, 356/127; 29/407.01, 407.04, 720; 451/390, 42, 240, 255, 256, 277, 5, 6, 8, 9, 10; 382/151

(56) References Cited

U.S. PATENT DOCUMENTS

| | | | | |
|---|---|---|---|---|
| 4,737,918 A | | 4/1988 | Langlois et al. | 364/474 |
| 4,798,459 A | | 1/1989 | Joncour | 356/127 |
| 5,155,940 A | | 10/1992 | Suzuki | 51/165.71 |
| 5,301,004 A | | 4/1994 | Percival et al. | 356/125 |
| 5,347,762 A | | 9/1994 | Shibata et al. | 451/15 |
| 5,498,200 A | * | 3/1996 | Werner | 451/460 |
| 5,716,256 A | | 2/1998 | Mizuno et al. | 451/5 |
| RE35,898 E | | 9/1998 | Shibata et al. | 451/5 |
| 5,844,671 A | * | 12/1998 | Kajino et al. | 356/124 |

FOREIGN PATENT DOCUMENTS

| | | | |
|---|---|---|---|
| DE | 38 29 488 | 3/1990 | G02C/12/00 |
| EP | 0 363 281 | 4/1990 | G02C/13/00 |
| EP | 0 409 760 | 1/1991 | B24B/9/14 |
| EP | 0 753 781 | 1/1997 | G02C/13/00 |
| EP | 0 876 874 | 11/1998 | B24B/13/005 |
| EP | 0 933 163 A1 | 8/1999 | B24B/13/005 |
| JP | 63-212916 | 9/1988 | G02C/13/00 |
| JP | 2-210238 | 8/1990 | G01M/11/02 |
| JP | 3-17530 | 1/1991 | G01M/11/02 |
| JP | 3-113415 | 5/1991 | G02C/13/00 |
| JP | 3-149168 | 6/1991 | B24B/9/14 |
| JP | 5-212661 | 8/1993 | B24B/9/14 |
| JP | 6-11469 | 2/1994 | B24B/9/14 |
| JP | 6-511557 | 12/1994 | G01M/11/02 |
| JP | 8-18236 | 2/1996 | B24B/9/14 |
| JP | 8-247895 | 9/1996 | G01M/11/02 |
| JP | 9-253999 | 9/1997 | B24B/9/14 |
| JP | 10-104118 | 4/1998 | G01M/11/02 |
| JP | 2786848 | 5/1998 | B24B/9/14 |

* cited by examiner

*Primary Examiner*—Frank G. Font
*Assistant Examiner*—Layla Lauchman
(74) *Attorney, Agent, or Firm*—Sughrue Mion, PLLC

(57) ABSTRACT

In a cup attaching apparatus, a cup is attached as a processing jig to a subject lens along a reference axis, the lens and an index plate having an index of a predetermined pattern are illuminated by substantially parallel rays of light shaped into a diameter larger than a diameter of the lens so that an image of the lens and an image of the index are projected onto a screen, and the index image projected onto the screen is detected, whereas an entire image of the lens projected onto the screen is picked up. An optical center of the lens with respect to the reference axis is obtained on the basis of the index image detected by said detecting means, thereby displaying in a superposed manner alignment information indicating a relative position of the optical center with respect to the reference axis and the image thus picked up. The alignment is effected while observing the displayed information.

43 Claims, 12 Drawing Sheets

CUP ATTACHING APPARATUS

CROSS-REFERENCE TO RELATED APPLICATIONS

This application is a continuation-in-part application of U.S. application Ser. No. 09/239,317 filed on Jan. 29, 1999.

BACKGROUND OF THE INVENTION

1. Field of the Invention

The present invention relates to a cup attaching apparatus for attaching a cup as a processing jig to a subject lens which is processed by an eyeglass lens processing apparatus.

2. Description of the Related Art

When a subject lens is ground by a processing apparatus, a cup (a suction cup, a cup which is fixed with a pressure sensitive adhesive sheet placed in between, or the like) as a processing jig is attached to the subject lens by means of a cup attaching apparatus as a preliminary-step operation. Conventionally, the cup attaching operation is generally performed as follows.

In cases where the subject lens is a unifocal lens, the lens is first marked with a marked point in alignment with the position of the optical center and the direction of the cylinder axis of the subject lens by using a lens meter. Subsequently, the subject lens is moved to the cup attaching apparatus, the marked point on the subject lens and a reference scale of the attaching apparatus are projected onto a screen, and while observing them, positioning (alignment) is effected so that the reference scale and the marked point assume a predetermined positional relationship, and the cup is attached to the subject lens.

In addition, in the case of multifocal lenses such as a progressive multifocal lens and a bifocal lens, layout marks provided on the lens surface and a small lens portion of the lens are projected onto the screen, positioning (alignment) is effected on the basis of the projected image and the reference scale, and the cup is attached to the subject lens.

However, with the method using the above-described conventional apparatus, the lens meter and the cup attaching apparatus are required for attaching the cup to the unifocal lens, so that this method is disadvantageous in terms of the installation space and economic efficiency. In addition, the respective apparatuses must be operated, so that the operating efficiency is poor.

Further, on the cup attaching apparatus side, an alignment operation for effecting positioning in conformity with the marked point is required, it is not easy for a person unskilled in the operation to speedily perform the positioning (alignment) with high accuracy. The poor positioning (alignment) accuracy leads to an error at the time of processing. Particularly in processing centers where subject lenses are processed in a concentrated manner, there has been a demand for controlling the occurrence of processing errors, due to cup attachment and for improving the operating efficiency as much as possible.

Furthermore, when the cup is attached to the subject lens, confirmation is necessary as to whether or not the lens diameter is sufficiently large enough for an eyeglasses frame into which the lens is fitted, but this confirmation operation has not been easy.

SUMMARY OF THE INVENTION

In view of the above-described problems, it is an object of the present invention to provide an apparatus which makes it possible to efficiently perform the cup attaching operation by facilitating the alignment for attaching the cup without performing the marking operation on the subject lens, and which makes it possible to easily confirm processability.

To attain the above-noted object, the present invention provides the following.

A cup attaching apparatus having an attaching device with a reference axis to attach a cup as a processing jig to a subject lens along the reference axis; an illuminating device for illuminating the lens and an index plate having an index of a predetermined pattern by rays of light shaped into a diameter larger than a diameter of the lens. The cup attaching apparatus further includes a screen for projecting an image of the lens and an image of the index which are formed by the illuminating device; an imaging device for picking up the images projected onto the screen; an optical-center detecting device for obtaining a position of an optical center of the lens by processing the index image picked up by the imaging device; and a display device for displaying in a superposed manner information on the position of the optical center obtained by the optical-center detecting device and the lens image picked up by the imaging device. In the above cup attaching apparatus, attachment of the cup to the lens is effected by alignment while observing display by the display device.

The present invention also provides a cup attaching apparatus having an attaching device having a reference axis to attach a cup as a processing jig to a subject lens along the reference axis. The cup attaching apparatus further includes an illuminating device for illuminating the lens and an index plate having an index of a predetermined pattern; an index detecting device for detecting an image of the index formed by the illuminating device; an optical-center detecting device for obtaining a position of an optical center of the lens with respect to the reference axis on the basis of a result of detection by the index detecting device; and a position storing device for storing information on the position of the optical center obtained by the optical-center detecting device when the cup is attached to the lens by the attaching device. In the foregoing cup attaching apparatus, the information on the position of the optical center stored by the position storing device is used as information on correction at the time of processing by an eyeglass lens processing apparatus.

The present invention also provides a cup attaching apparatus for attaching a cup onto an eyeglass lens, the cup being adapted to fix the eyeglass lens onto a lens rotating shaft of a lens processing apparatus. The cup attaching apparatus has a cup attaching device for moving the cup to the lens placed at a predetermined position, and attaching the cup onto the lens; a detecting device, provided with a measurement optical system having a measurement light source, a measurement index plate and a photoelectric detector, for detecting a position of an optical center of the lens and a direction of a cylinder axis of the lens; a cylinder axis instructing device for instructing a direction of the cylinder axis of the lens; and a display device for displaying a reference mark indicating a predetermined reference position, and an optical center mark and a cylinder axis mark both based on a result of detection by the detecting device, the optical center mark indicating the position of the optical center of the lens with respect to the predetermined reference position, the cylinder axis mark indicating the direction of the cylinder axis of the lens with respect to the intructed direction of the cylinder axis.

Other objective and features of the invention will become evident in the course of the description thereof, which follows.

DESCRIPTION OF THE PREFERRED EMBODIMENTS

First Embodiment

Figure 1:
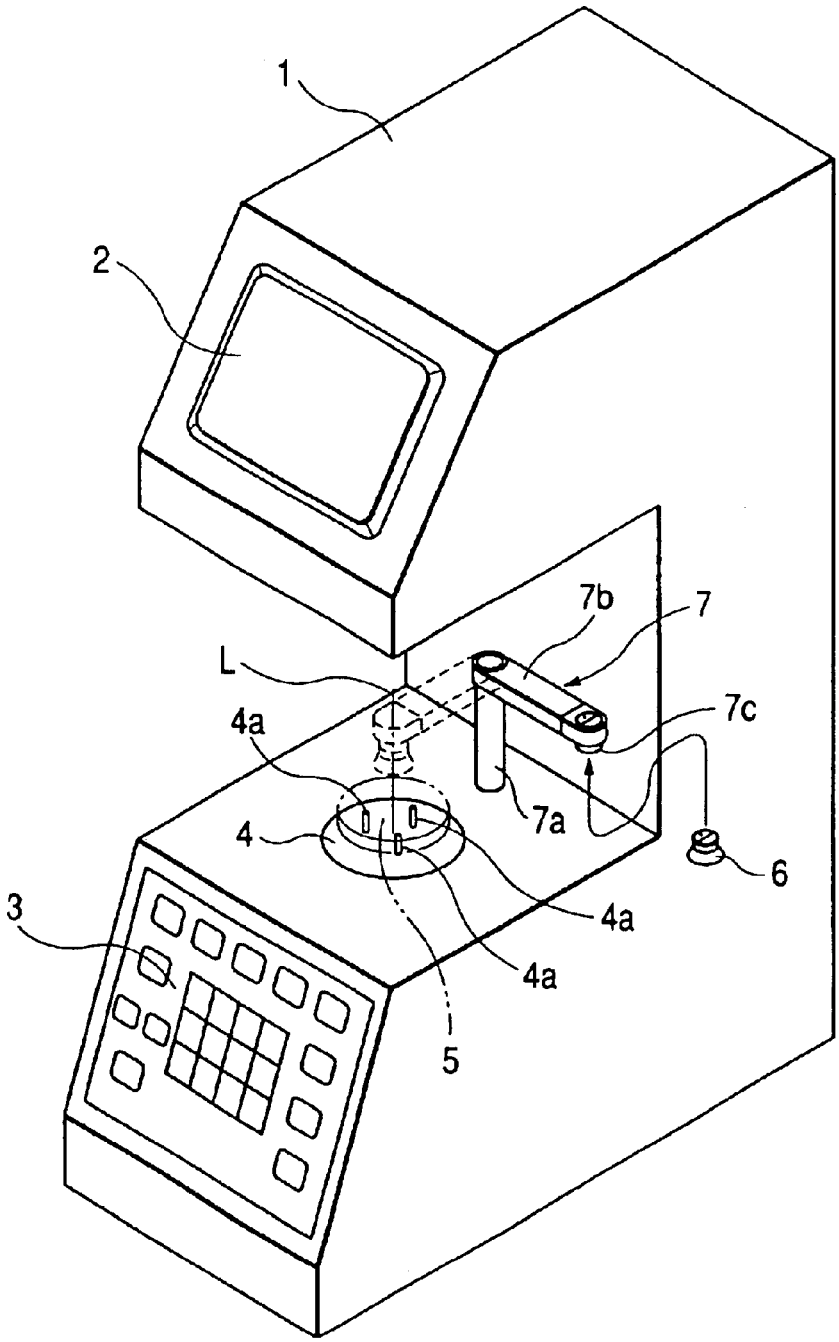
FIG. 1 is an external view of the apparatus in accordance with a first embodiment.
Figure 2:
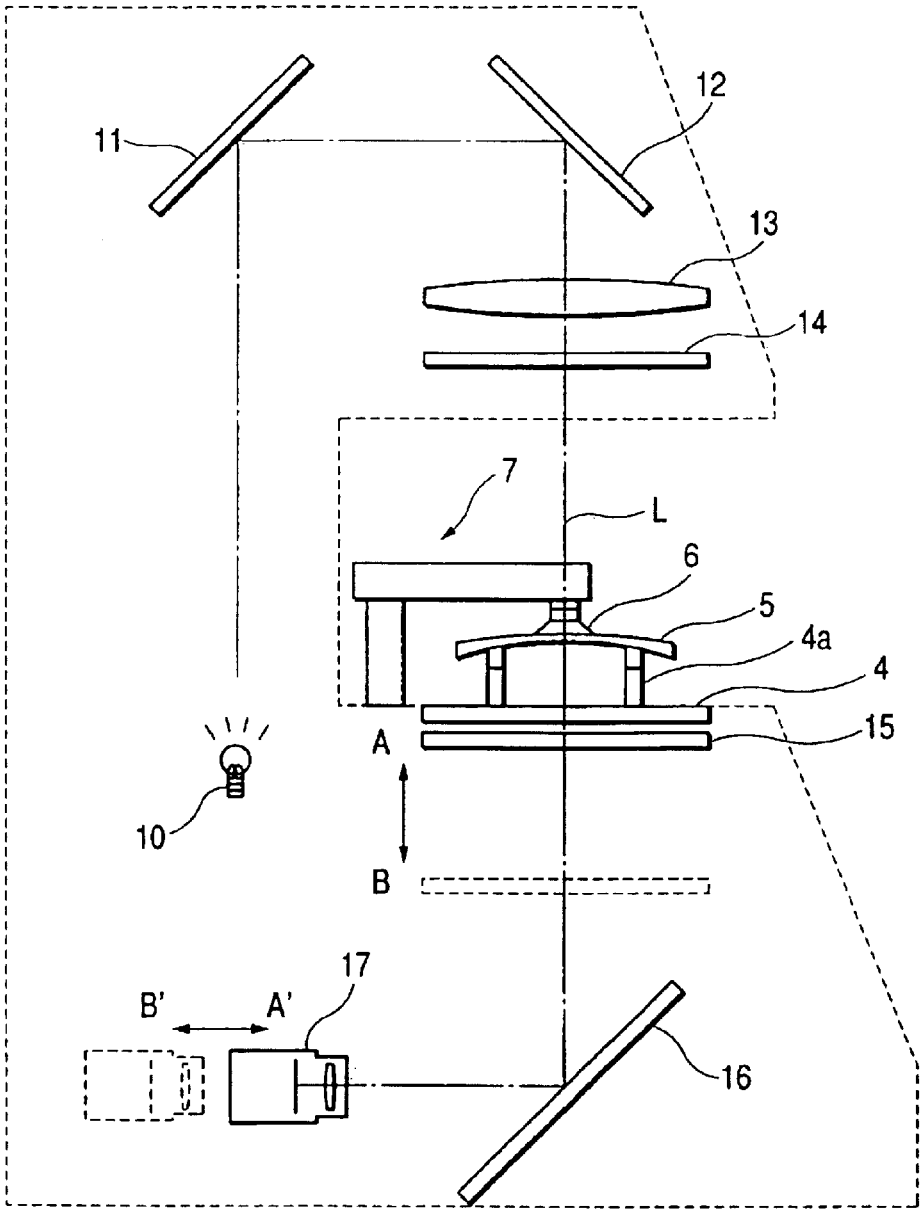
FIG. 2 is a diagram illustrating an optical system of the apparatus in accordance with the first embodiment.

Referring now to FIGS. 1 to 8, a description will be given of a first embodiment of the present invention. FIG. 1 is an external view of the apparatus in accordance with the first embodiment of the present invention. Reference numeral 1 denotes an apparatus main body having substantially U-shaped side surfaces, and an illuminating optical system and an imaging optical system shown in FIG. 2 are disposed therein. A monitor 2 such as a liquid-crystal display is provided on an upper front surface of the main body 1, and a switch panel 3 is provided on a lower front surface. Displayed on the monitor 2 are an image of a subject lens 5 which is imaged by a CCD camera, which will be described later, various marks for alignment, a layout screen (items to be inputted for layout), and the like.

Numeral 4 denotes a mounting portion for mounting the lens 5. The bottom of the mounting portion 4 is formed of a transparent member so that illumination light from above passes through the lens 5 and reaches a screen plate 15 (see FIG. 2) inside the main body 1. Three lens supporting portions 4*a* are embedded in the mounting portion 4 at equal intervals with a reference axis L as a center, thereby supporting the lens 5 stably without tilting. Distal ends of the supporting portions 4*a* are formed of a material such as a soft synthetic resin so as not to damage the lens 5.

Numeral 7 denotes a lens attaching portion for attaching a cup 6 to the lens 5. The attaching portion 7 has a shaft 7*a* which rotates by means of a motor 31 and moves vertically by means of a motor 32 (see FIG. 3), and an arm 7*b* fixed to the shaft 7*a*. An attaching portion 7*c* for fitting a proximal portion of the cup 6 is provided on the underside of a distal end of the arm 7*b*. The cup 6 is attached in a predetermined direction in accordance with a positioning mark provided on an upper surface of the arm 7*b*. When the arm 7*b* rotates to the position indicated by the dotted lines in conjunction with the rotation of the shaft 7*a*, the center of the cup 6 is adapted to arrive at the reference axis L. It should be noted that the cup 6 may be of a type in which it is sucked onto the surface of the lens 5 or a type in which it is fixed with a pressure sensitive adhesive sheet placed in between.

FIG. 2 is a diagram illustrating a schematic configuration of the optical system inside the main body 1. Numeral 10 denotes an illuminating light source for illuminating the lens 5. The illuminating light from the light source 10 passes through reflecting mirrors 11 and 12, is converted into parallel rays of light having a larger diameter than that of the lens 5 by means of a collimator lens 13, and is then transmitted through an index plate 14. A ring index with its center set on the reference axis L is formed on the index plate 14, and the illuminating light including the ring index beam illuminates the lens 5 from above along the reference axis L.

Numeral 15 denotes the screen plate formed of a semi-transparent material (e.g., ground glass), and an image of the lens 5 illuminated by the illuminating light from above as well as an image of the ring index which passed through the lens 5 are projected onto the screen plate 15. The images projected onto the screen plate 15 are imaged from the rear by a CCD camera 17 having an imaging lens through a mirror 16, and are displayed on the monitor 2.

Figure 3:
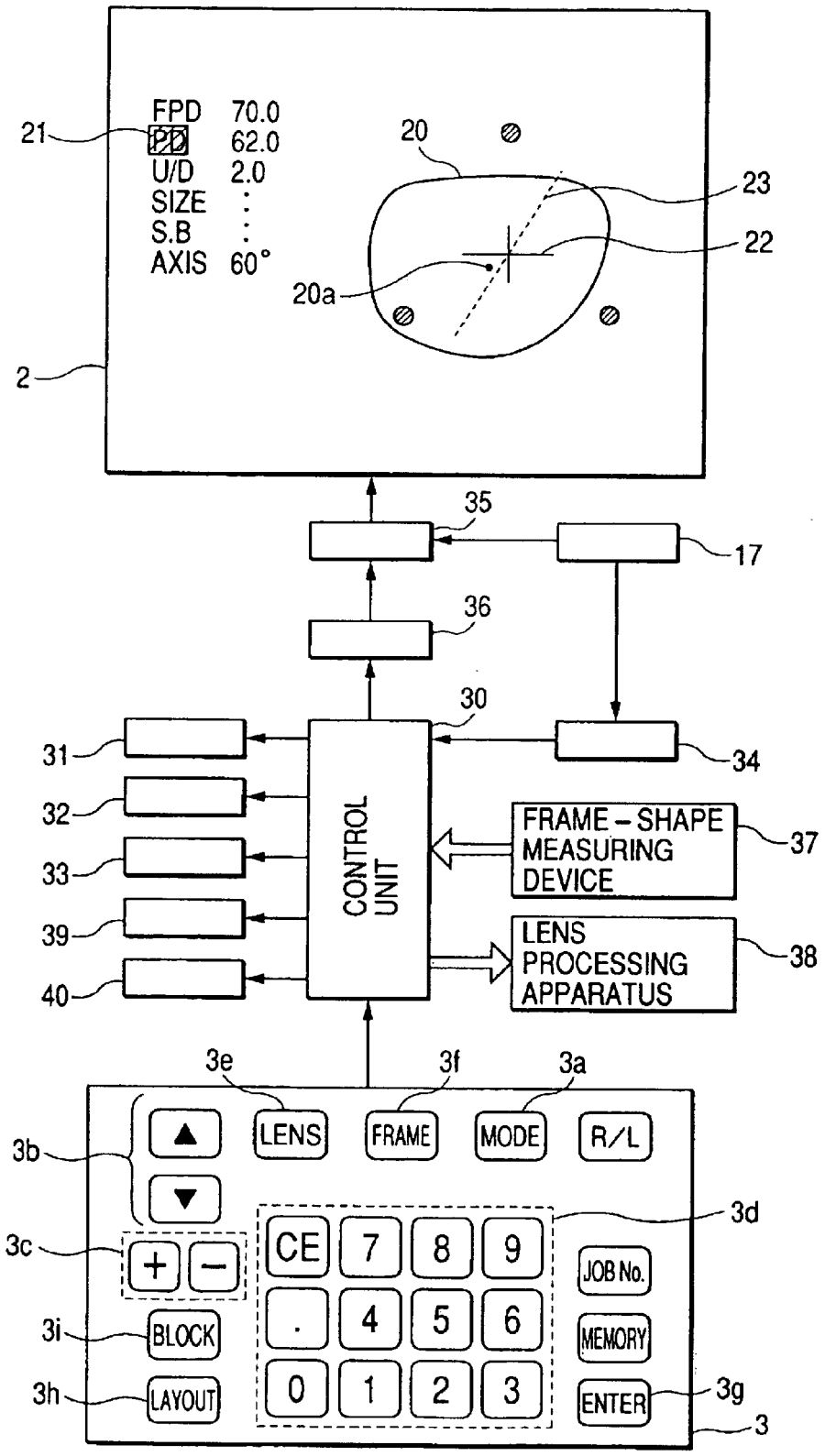
FIG. 3 is a diagram illustrating a controlling system of the apparatus in accordance with the first embodiment.

Further, the screen plate 15 is movable between a position A in the vicinity of the mounting portion 4 in FIG. 2 and a position B spaced apart a predetermined distance therefrom by means of a screen driving motor 33 (see FIG. 3). In multifocal lenses such as a bifocal lens and a progressive lens, since positioning (alignment) is effected on the basis of projected images of the layout marks provided on the lens 5 and the small lens portion (which will be described later), the screen plate 15 is disposed at the position A so as to minimize the distortion of the projected image due to the refractive power of the lens 5. In the unifocal lens, on the other hand, since the position of the optical center and the direction of cylinder axis of the lens are determined on the basis of the offset (displacement) of the ring index image due to the refractive power of the lens 5 (which will be described later), the screen plate 15 is disposed at the position B spaced apart from the lens 5 so as to facilitate the detection of the offset (displacement) of the ring index image.

In addition, the CCD 17 is also movable in the direction of the arrow (in the direction of the imaging optical axis) by means of a camera driving motor 39 (see FIG. 3), and at the same time as the screen plate 15 moves from the position A to the position B, the CCD 17 also moves from the position A' to the position B', thereby focusing the image projected onto the screen plate 15.

Figure 4:
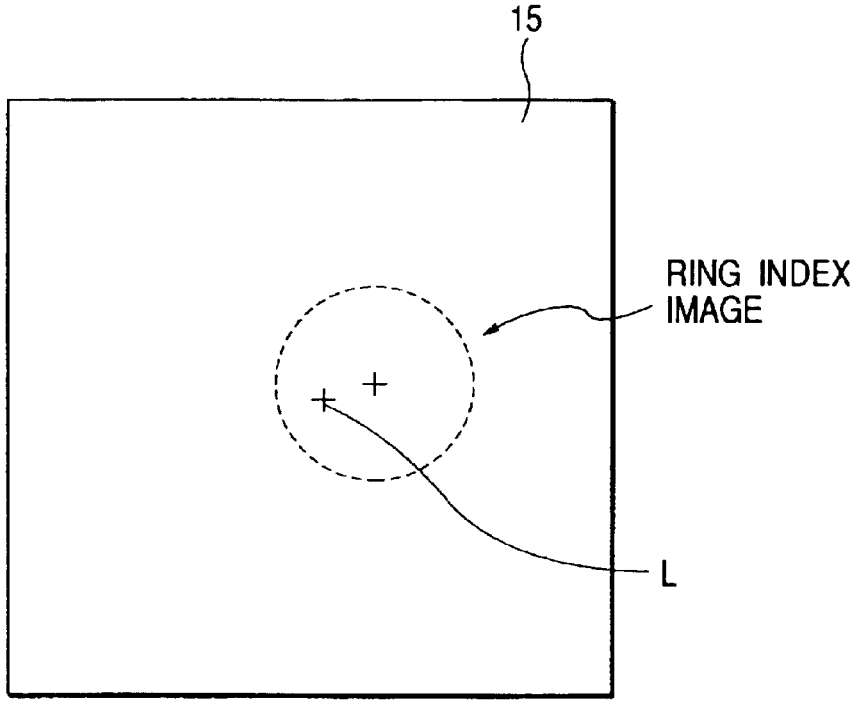
FIG. 4 is a diagram illustrating the offset of the central position of a ring index image projected onto a screen plate from a reference axis when the subject lens is mounted.
Figure 5:
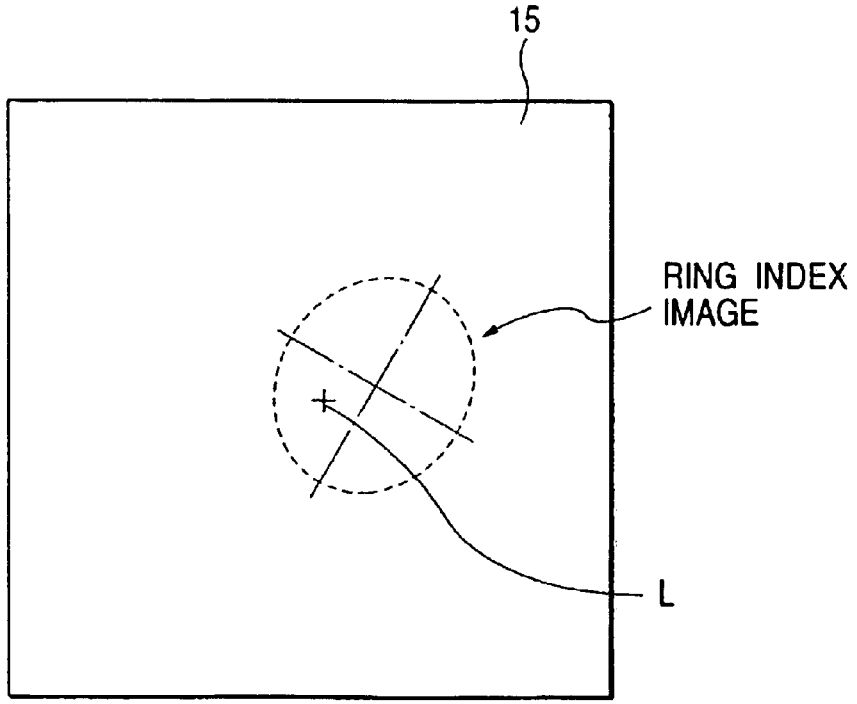
FIG. 5 is a diagram illustrating the ring index image projected onto the screen plate when the subject lens has cylindrical refractive power.

FIG. 3 is a diagram illustrating a controlling system of the apparatus. An image signal from the CCD 17 is inputted to an image synthesizing circuit 35, and the circuit 35 combines the image signal with characters and marks generated by a display circuit 36 connected to a control unit 30, and displays the same on the monitor 2. The image signal from the CCD 17 is inputted to an image processing circuit 34 as well. The circuit 34 detects the position of the ring index image projected onto the screen plate 15 through the lens 5, and inputs the detected signal to the control unit 30. On the basis of the detected signal, the control unit 30 obtains the offset of the central position of the ring index image projected onto the screen plate 15, in correspondence with the mounted position of the lens 5, i.e., the amount of displacement of the position of the optical center, as shown in FIG. 4. When the lens 5 has cylindrical refractive power (astigmatic power), the ring index image projected onto the screen plate 15 changes into an elliptical shape a shown in FIG. 5, so that the direction (angle) of the cylinder axis is obtained on the basis of the inclination (in the direction of the long axis) of the elliptical shape. In addition, the direction (angle) of the cylinder axis may be alternatively determined from the short axis direction of the ellipse.

Furthermore, also connected to the control unit 30 are the motor 31 for rotating the shaft 7*a* of the attaching portion 7, the motor 32 for vertically moving the shaft 7*a*, the motor 33 for moving the screen 15, a frame-shape measuring device 37 for measuring the shape of an eyeglasses frame, a processing apparatus 38 for grinding the lens 5, the motor 39 for moving the CCD 17, a memory 40 for storing the inputted data and the like, and the switch panel 3.

A description will be given of the operation of the apparatus having the above-described configuration. First, the shape of the eyeglasses frame into which the lens 5 is fitted is measured in advance by the measuring device 37, and its data is inputted. The inputted frame shape data is stored in the memory 40, and an intended lens shape figure (a target lens configuration figure) 20 based on the inputted frame shape data is displayed on the monitor 2 (the intended lens shape figure for the right eye is initially displayed). The operator inputs frame-fitting conditions, including the layout of the lens with respect to the frame shape and the type of the lens, by operating the switch panel 3. The type of the lens is selected by a MODE key 3*a*. Hereafter, a description will be given of cases where the types of the lenses to be processed are a unifocal lens, a progressive multifocal lens, and a bifocal lens, respectively.

<Unifocal Lens>

In the unifocal lens mode, the optical center mode for axially positioning (aligning) the cup at the position of the optical center of the lens and the frame center mode for axially positioning (aligning) the cup at the position of the geometric center of each eyeglasses frame portion can be further selected by the key 3*a*.

(A) Optical Center Mode

Since input items for the layout of the lens are displayed on the left-hand side of the screen of the monitor 2, a highlighted cursor 21 is moved by a cursor moving key 3*b* to select items to be inputted. The values of the input items can be changed by a "+" "−" key 3*c* or a ten-key pad 3*d*, and layout data including FPD (the distance between geometric centers of both eyeglasses frame portions), PD (pupillary distance), and U/D (the height of the optical center with respect to the geometric center of each eyeglasses frame portion) are inputted. In addition, across mark 22 having a center at the position aligned with the reference axis is displayed on the screen of the monitor 2, and the intended lens shape figure (the target lens configuration figure) 20 and an intended lens center mark 20*a* showing the geometric center of the intended lens shape are displayed after being moved with respect to the center of the cross mark 22 on the basis of the inputted layout data.

When the lens 5 has cylindrical refractive power (astigmatic power), the cursor 21 is moved to an item AXIS, and the astigmatic axial angle (direction) in the prescription is inputted in advance. An AXIS mark 23 corresponding to the inputted axial angle (direction) is displayed on the monitor 2.

Incidentally, this layout data may be transferred to the processing apparatus 38, and the type of the lens 5 (the type such as plastics and glass) and the type of the eyeglasses frame may be inputted in advance by a LENS key 3*e* and a FRAME key 3*f*, respectively, so that processing can be performed directly by using the layout data.

When necessary inputs have been made, an ENTER key 3*g* is pressed. In the case of the unifocal lens mode, the control unit 30 causes the screen plate 15 and the CCD 17 to move to the positions B and B', respectively, by operating the motors 33 and 39.

Figure 6A:
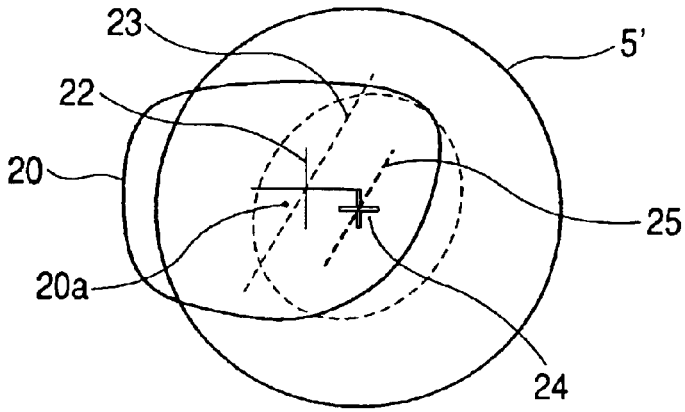
FIGS. 6A and 6B are diagrams explaining the intended lens shape figure and the image of the subject lens which are displayed on a monitor in a unifocal lens.
Figure 6B:
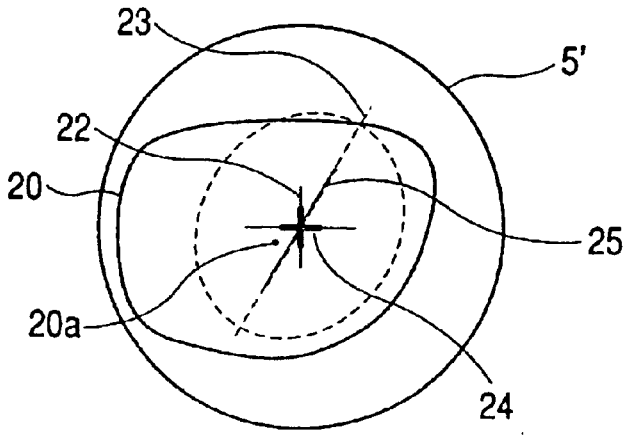

When the setting of the apparatus is completed, the operator mounts the lens 5 on the mounting portion 4, and performs adjustment for centering. When the lens 5 is mounted on the mounting portion 4, images of the lens 5 and the ring index image which passed it are projected onto the screen plate 15, and are imaged by the CCD 17. In the case of the unifocal lens mode, the control unit 30 continuously obtains the amount of offset (displacement) of the position of the optical center from the reference axis L and the direction of cylinder axis on the basis of the detected signal of the ring index image detected by the circuit 34. As shown in FIG. 6A, an optical center mark 24 indicating the position of the optical center and an AXIS mark 25 indicating the direction of the cylinder axis are displayed by the circuit 36 based on information of the amount of offset (displacement) of the position of the optical center and the direction of the cylinder axis which the control unit 30 obtained. While viewing this display, the operator moves the lens 5 in such a manner that the center of the optical center mark 24 coincides with the center of the cross mark 22, thereby effecting the positioning (alignment) of the position of the optical center of the lens 5 with respect to the reference axis L. Further, the lens 5 is rotated in such a manner that the inclination of the AXIS mark 25 is aligned with the AXIS mark 23, thereby adjusting the direction of the cylinder axis of the lens 5 to the direction of astigmatic axis in the prescription. When the position of the optical center of the lens 5 and the direction of the cylinder axis are aligned, if the shapes or the colors of the optical center mark 24 and AXIS mark 25 are changed and the operator is notified to that effect, ease of use is further facilitated.

After the centering is thus completed, that state is kept intact, and a LAYOUT key 3*h* is pressed. The control unit 30 causes the screen plate 15 to move from the position B to the position A in the vicinity of the mounting portion 4, and moves the CCD 17 to the point A'. As a result, the an outside diameter contour image of the lens 5 projected onto the screen plate 15 is projected as a real size substantially without being affected by its refractive power. By observing a lens image 5' and the intended lens shape figure (the target lens configuration figure) 20 which are displayed on the monitor 2 (see FIG. 6B), the operator is able to easily determine processability as to whether or not the lens diameter is lacking for processing. Incidentally, when the lens diameter is clearly sufficient for the frame shape, the screen plate 15 may not necessarily be moved.

If there is no problem with the diameter of the lens 5, a BLOCK key 3*i* is pressed. The control unit 30 drives the motor 31 to rotate the shaft 7*a* so that the cup 6 fitted in advance on the attaching portion 7 arrives at the reference axis L, and the control unit 30 then drives the motor 32 to lower the cup 6, and allows the cup 6 to suck the lens 5.

(B) Frame Center Mode

A brief description will be given of portions which differ from the case of the optical center mode. It should be noted that it is advisable to employ the frame center mode when the amount of moving over is large in the optical-center layout, and the so-called processing interference occurs on the processing apparatus 38 side.

In the same way as in the optical center mode, the layout data, including FPD, PD, and U/D, and the astigmatic axial angle (direction) are entered. The display of the intended lens center mark 20*a* is fixed as aligned with the reference axis L, and the cross mark 22 and the AXIS mark 23 are displayed at the positions where they are moved on the basis of the inputted layout data. The optical center mark 24 which is displayed when the lens 5 is mounted on the mounting portion 4 is aligned with the cross mark 22, thereby performing the centering adjustment. In the case of a lens having cylindrical refractive power (astigmatic power), after the AXIS mark 25 displayed in the same way as in the optical center mode is aligned with the AXIS mark 23, the cup 6 is attached. It should be noted that, in this case as well, if the screen plate 15 is moved in advance to the position A before the attachment of the cup 6, it is possible to easily determine the processability by observing the lens image 5' and the intended lens shape figure (the target lens configuration figure) 20.

<Progressive Multifocal Lens>

A description will be given of the case of the progressive multifocal lens. In the progressive multifocal lens mode, the screen plate 15 is disposed at the position A. In the same way as described above, the layout data is entered by using the respective keys on the panel 3. In the progressive multifocal lens mode, the cross mark 22 is displayed fixedly with its center aligned with the reference axis L, and the displayed positions of the intended lens shape figure (the target lens configuration figure) 20 and the intended lens center mark 20*a* change in correspondence with the inputted layout data. Incidentally, the frame center mode may also be provided in the same way as with the unifocal lens.

Figure 7:
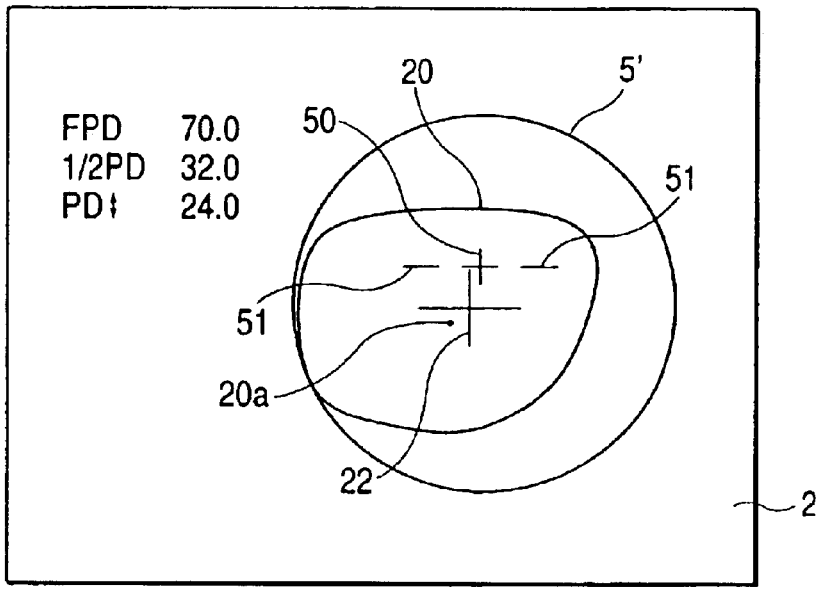
FIG. 7 is a diagram explaining the intended lens shape figure and the image of the subject lens which are displayed on the monitor in a progressive multifocal lens.

Since the progressive multifocal lens in the state supplied from a lens manufacturer is provided with the layout marks indicating such as an eyepoint for far use and the horizontal direction, the centering adjustment is effected while observing the layout mark images which are projected onto the screen plate 15 and displayed on the monitor 2. FIG. 7 shows an example of the screen at this time, in which reference numeral 50 denotes an image of the eyepoint mark for far use, and numeral 51 denotes an image of the horizontal line mark. The eyepoint mark for far use and the horizontal line mark are clearly displayed by being projected onto the screen plate 15. After the operator completes centering adjustment by moving the lens 5 such that the mark image 50 and the mark image 51 are superposed on the cross mark 22, the operator allows the cup 6 to suck the lens 5.

<Bifocal Lens>

Figure 8:
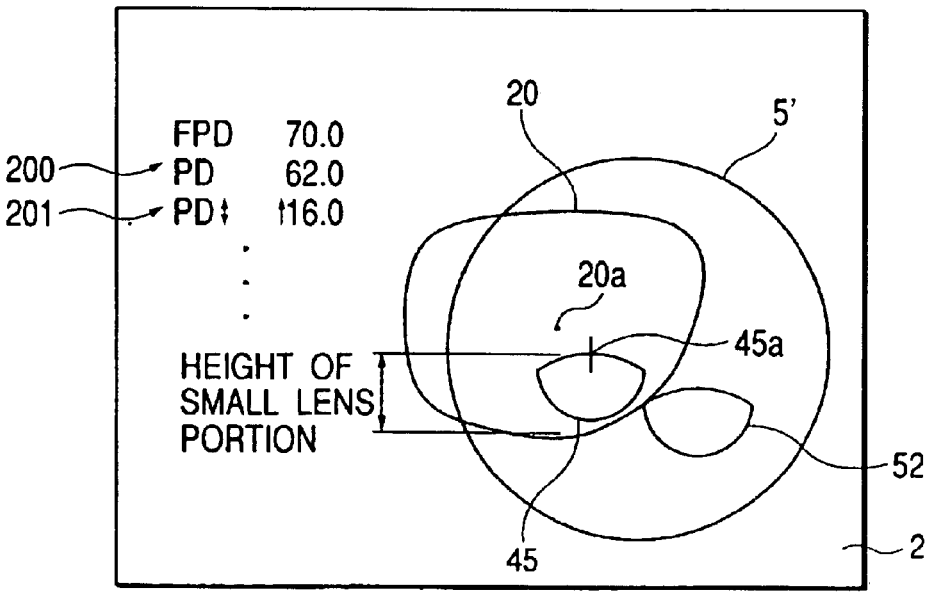
FIG. 8 is a diagram explaining the intended lens shape figure and the like which are displayed on the monitor in a bifocal lens.

In this mode, the screen plate 15 is disposed at the position A. As shown in FIG. 8, in the bifocal lens mode, a small lens portion layout mark 45 is displayed in addition to the intended lens shape figure (the target lens configuration figure) 20. The layout data is entered by operating the panel 3 in accordance with the input items shown on the left side. In an item 200, the pupillary distance for near use is entered. In an item 201, the distance from the' center of the upper line of the small lens portion to the bottom side of the intended lens shape immediately therebelow (that is to say, the height of the small lens portion) is fitted is entered. As a result, an upper center position mark 45*a* of the mark 45 is determined by using the intended lens center mark 20*a* as a reference.

The positioning (alignment) of the bifocal lens is performed as follows. When the lens 5 is mounted on the mounting portion 4, a projected image obtained by the illuminating light is displayed on the monitor 2, and the small lens portion of the lens 5 is clearly displayed by being projected onto the screen plate 15. The lens 5 is moved in such a manner that a displayed image 52 of the small lens portion is superposed on the mark 45, and positioning (alignment) is effected in such a manner that the upper center of the small lens portion image 52 is superposed on the upper center portion mark 45*a* of the mark 45. This completes the positioning (alignment), so that after confirming the processability by comparing the intended lens shape Figure 20 and the lens image 5', the key 3*i* is pressed to attach the cup 6.

Although in this embodiment the screen plate 15 is moved to two locations, the screen plate 15 may be moved vertically without steps and may be stopped at such a position that allows the optical center to be determined easily.

Further, a mechanism which allows the index plate 14 to move into and away from the optical path may be provided, and the index plate 14 may be moved away from the optical path when the detection of the position of the optical center is not required as in the case of a multifocal lens. If such an arrangement is adopted, when the image of the lens 5 is observed to make positional adjustment, an image of the index does not come in the way and is easy to observe.

Further, although in this embodiment the index plate 14 is disposed between the light source 10 and the lens 5, the present invention is not limited to the same, and the index plate 14 may be disposed between the lens 5 and the screen plate 15, or the mounting plate 4 may be used to serve as the index plate 14.

Second Embodiment

Figure 9:
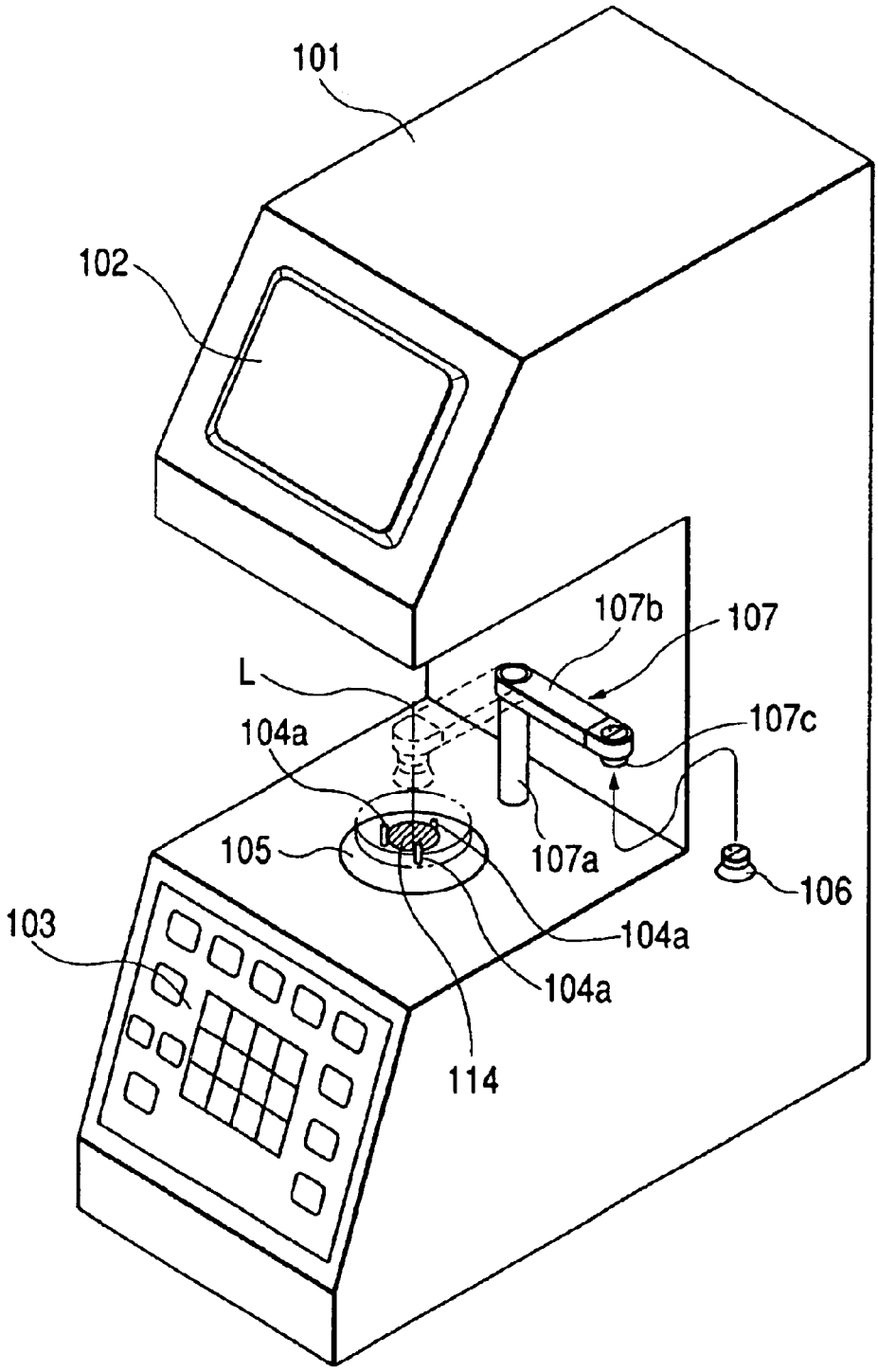
FIG. 9 is an external view of the apparatus in accordance with a second embodiment.
Figure 10:
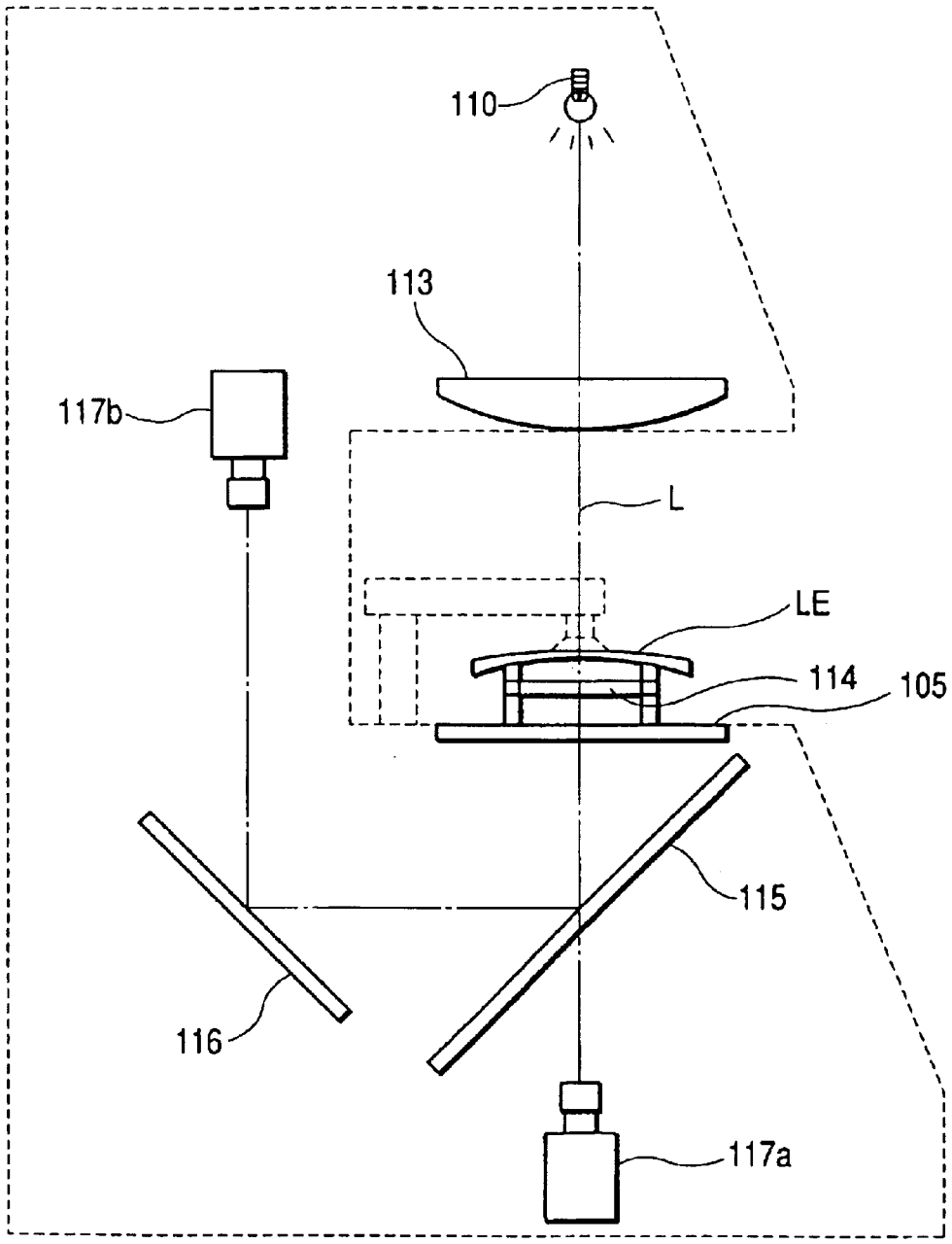
FIG. 10 is a diagram illustrating an optical system of the apparatus in accordance with the second embodiment.

Referring now to FIGS. 9 to 15, a description will be given of a second embodiment of the present invention. FIG. 9 is an external view of the apparatus in accordance with the second embodiment of the present invention, and FIG. 10 is a diagram illustrating a schematic configuration of an optical system in the apparatus. Reference numeral 101 denotes an apparatus main body having substantially U-shaped side surfaces, and an illuminating optical system and an imaging optical system shown in FIG. 10 are disposed therein. A monitor 102 such as a liquid-crystal display is provided on an upper front surface oft the main body 101, and a switch panel 103 is provided on a lower front surface. Displayed on the monitor 102 are an image of a subject lens LE which is imaged by a second CCD camera, which will be described later, various marks for alignment, a layout screen (items to be inputted for layout), and the like.

Numeral 105 denotes a screen plate made of semi-transparent or translucent material (for instance, frosted or grounded glass). Three lens supporting portions 104 are implanted or projectingly provided on the screen plate 105 at equal angular intervals about a reference axis L so as to place the lens thereon. Each of the lens supporting portions 104 has such a length that the lens LE is distanced about 15 mm from the screen plate 105 when the lens LE is placed. An index plate 114 on which a prescribed pattern is formed is mounted to the supporting portions 104*a* so as to be located below the lens LE when the lens is placed. The index plate 114 in this embodiment is constructed by a transparent glass plate on which black dot indexes are provided at 0.5 mm pitches in an square area of 20 mm×20 mm about the reference axis L to define grid arrangement. The index plate 114 may be disposed on the illumination light source side with respect to the lens LE.

Numeral 107 denotes a cup attaching portion for attaching a cup 106 as a processing jig to the lens. The attaching portion 107 has a shaft 107*a* which rotates by means of a motor 131 and moves vertically by means of a motor 132 (see FIG. 11), and an arm 107*b* fixed to the shaft 107*a*. An attaching portion 107*c* for fitting a proximal portion of the cup 106 is provided on the underside of a distal end of the arm 107*b*. The cup 106 is attached in a predetermined direction in accordance with a positioning mark provided on an upper surface of the arm 107*b*. When the arm 107*b* rotates to the position indicated by the dotted lines in conjunction with the rotation of the shaft 107*a*, the center of the cup 106 is adapted to arrive at the reference axis L.

In FIG. 10, numeral 110 denotes an illuminating light source. The illuminating light from the light source 110 is converted into parallel rays of light having a larger diameter than that of the lens LE by means of a collimator lens 113, and is projected onto the lens LE. The light rays which were transmitted through the lens LE further illuminate an index plate 114, so that an entire image of the lens LE as well as index images of the index plate 114 subjected to the prismatic action of the lens LE are projected onto a screen plate 105. A half mirror 115 is disposed below the screen plate 105, and a first CCD camera 117*a* is provided on the reference axis L in the direction of its transmittance. This first CCD 117*a* is disposed at a position for imaging in enlarged form only a central region with the reference axis L set as a center so that the index images projected onto the screen plate 105 can be detected. Meanwhile, a mirror 116 as well as a second CCD camera 117*b* for imaging an image reflected by the mirror 116 are disposed in the reflecting direction of the half mirror 115. This second CCD 117*b* is disposed at a position for imaging the entire screen plate 105 so that the overall image of the lens LE projected onto the screen plate 105 can be obtained.

Figure 11:
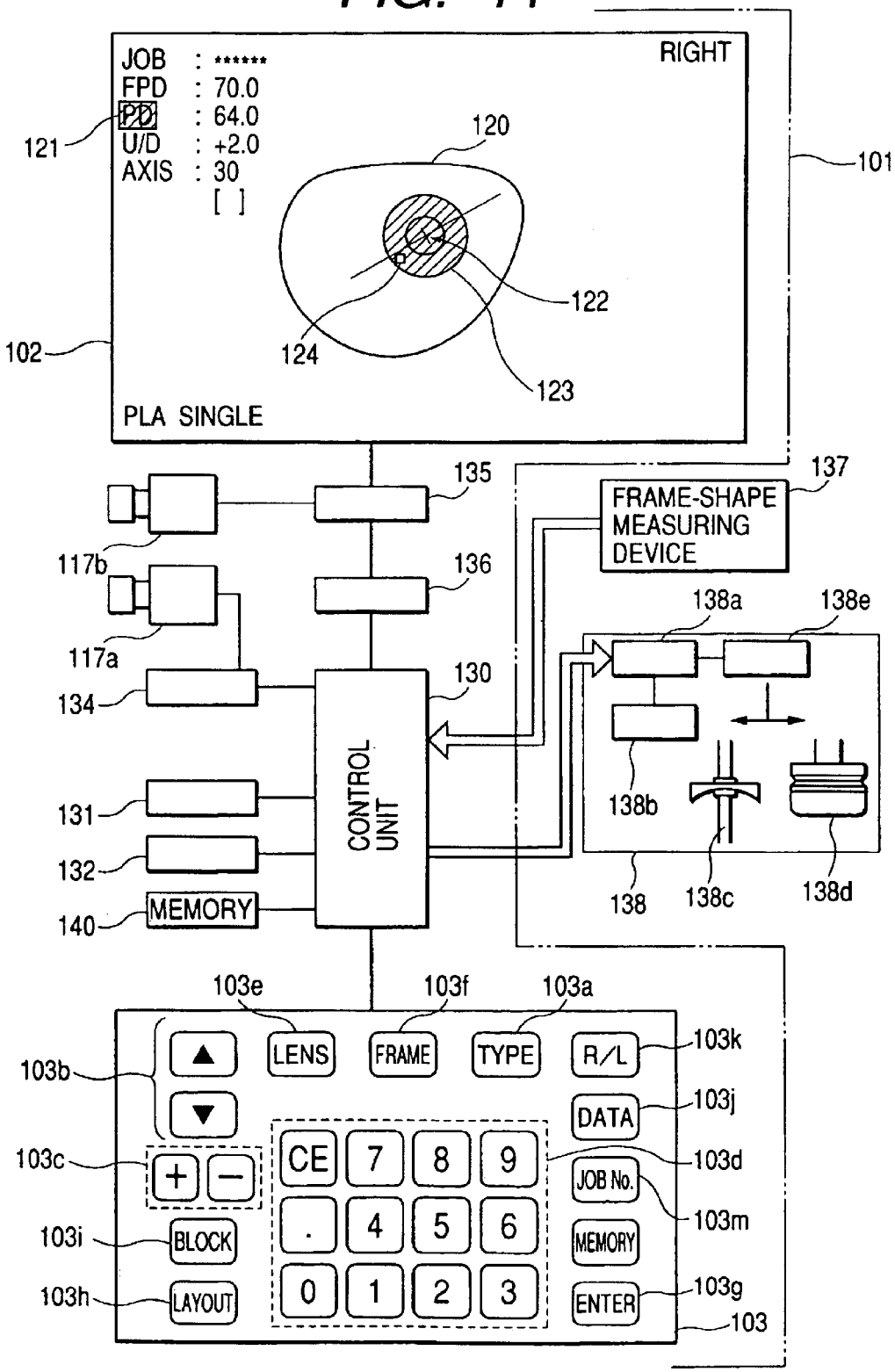
FIG. 11 is a diagram illustrating a controlling system of the apparatus in accordance with the second embodiment.
Figure 12:
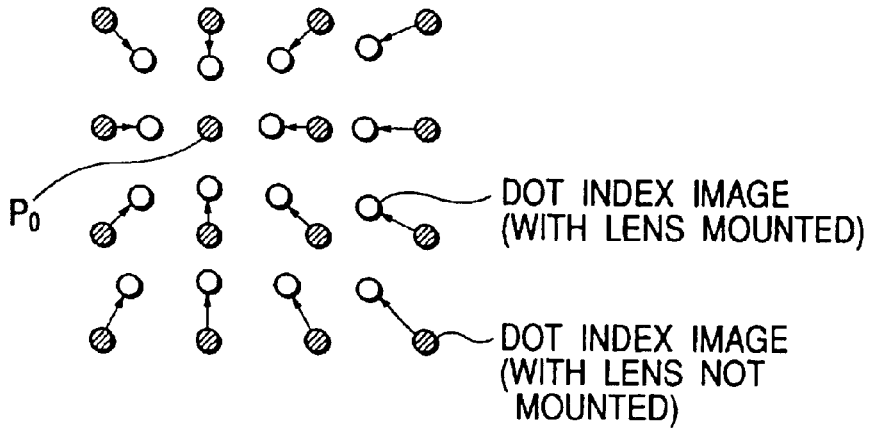
FIG. 12 is a diagram illustrating a method for detecting the position of the optical center of the subject lens from an index image.

FIG. 11 is a diagram illustrating a controlling system of the apparatus. An image signal from the first CCD 117*a* is inputted to an image processing unit 134. The processing unit 134 effects image processing to detect the position of the index images projected onto the screen plate 105, and inputs the detected signal to a control unit 130. On the basis of the detected signal, the control unit 130 determines the position of the optical center of the lens LE and the direction of the cylinder axis (which will be described later). Meanwhile, an image signal from the second CCD 117*b* is inputted to an image synthesizing circuit 135, and the circuit 135 combines the image signal with characters and marks generated by a display circuit 136 connected to the control unit 130, and displays the same on the monitor 102.

Furthermore, also connected to the control unit 130 are the motor 131 for rotating the shaft 107*a* of the attaching portion 107, the motor 132 for vertically moving the shaft 107*a*, a memory 140 for storing the inputted data and the like, the switch panel 103, a frame-shape measuring device 137 for measuring the shape of an eyeglasses frame, and a processing apparatus 138 for grinding the lens LE.

A description will be given of a method of determining the position of the optical center of the lens LE and the direction of the cylinder axis on the basis of the index images obtained by the first CCD 117*a*.

When the lens LE is not mounted, the dot indexes on the index plate 114 is illuminated by the parallel rays of light, so that the index images are projected as it is onto the screen plate 105. On the basis of the index images picked up by the first CCD 117*a* with the lens LE not mounted, the processing unit 134 determines the coordinate positions of the index images, and stores the same in advance. When the lens LE is mounted, the position of the dot index image located immediately below the vicinity of the optical center of the lens LE remains the same irrespective of the presence or absence of the lens LE, but the coordinate positions of the dot index images at portions which are not at the position of the optical center move due to the prismatic action of the lens LE. Accordingly, to detect the position of the optical center, a change in the coordinate position of each dot index image with the lens LE mounted with respect to the coordinate position of each dot index image with the lens LE not mounted is examined, and the position from or toward which the dot index images diverge or converge as the center is determined. Namely, the position of the center of this divergence or convergence can be detected as the position of the optical center. In the example shown in FIG. 12, for instance, since the coordinate positions of the dot index images with the lens LE not mounted converge with P0 as the center, the coordinate position of P0 can be detected as the position of the optical center. Even if the position of the optical center is located between dot indexes, it suffices if the position of the optical center is determined by interpolating the center of movement on the basis of the moving directions of the dot index images and the amounts of their movement.

When the lens LE has cylindrical refractive power (astigmatic power), the dot index images move in a direction toward (or away from) a generating line of the lens LE. Hence, the direction of the cylinder axis can be similarly detected by examining in which direction the dot index images are moving with respect to the coordinate positions of the dot index images with the lens LE not mounted.

Next, a description will be given of the operation of the apparatus having the above-described configuration. First, after the shape of the eyeglasses frame into which the lens LE is fitted is measured in advance by the measuring device 137 connected to the main body 101, if a DATA key 103*j* is pressed, data on the measured frame shape (which is also referred to as the intended lens shape) is inputted. The inputted frame shape data is stored in the memory 140, and an intended lens shape Figure 120 based on the inputted frame shape data is displayed on the monitor 102 (the intended lens shape figure for the right eye is initially displayed). The operator inputs frame-fitting conditions, including the layout of the lens with respect to the frame shape and the type of the lens, by operating the switch panel 103. The type of the lens is selected by a TYPE key 103*a*. Hereafter, a description will be given of cases where the types of the lenses LE to be processed are a unifocal lens, a progressive multifocal lens, and a bifocal lens, respectively.

<Unifocal Lens>

The unifocal lens mode is selected by the TYPE key 103*a*. Since input items for the layout of the unifocal lens are displayed on the left-hand side of the screen of the monitor 102, a highlighted cursor 121 is moved by a cursor moving key 103*b* to select items to be inputted. The values of the input items can be changed by a "+" "−" key 103*c* or a ten-key pad 103*d*, and layout data including FPD (the distance between geometric centers of both eyeglasses frame portions), PD (pupillary distance), and U/D (the height of the optical center with respect to the geometric center of each eyeglasses frame portion) are inputted. In addition, when the lens LE has cylindrical refractive power (astigmatic power), the cursor 121 is moved to the item AXIS, and the astigmatic axial angle (direction) in the prescription is inputted in advance.

In addition to the intended lens shape Figure 120, a cup shape Figure 123 showing the shape of the cup 106 to be attached to the lens LE and a cross mark 122 are both displayed on the screen of the monitor 2 (see FIG. 11) by using as the center the position on the screen corresponding to the reference axis L. The cup shape is stored in advance in the memory 140. On the screen, an intended lens center mark 124 shows the geometric center of the intended lens shape, and in the state prior to the mounting of the lens LE, the center mark 124 and the intended lens shape Figure 120 are displayed after being moved by using the center of the cup shape Figure 123 (the cup attaching center) as a reference on the basis of the inputted layout data. In addition, if the data on the angle (direction) of the astigmatic axis is inputted, the cross mark 122 is displayed with its long axis inclined in such a manner as to conform to that angle (direction).

Incidentally, at the time of inputting data, the layout data may be transferred to the processing apparatus 138, and the type of the lens LE (the type such as plastics and glass) and the type of the eyeglasses frame may be inputted in advance by a LENS key 103*e* and a FRAME key 103*f*, respectively, so that processing can be performed directly by using the layout data.

When necessary data have been inputted, the operator mounts the lens LE on a supporting portion 104*a*, and performs rough positioning (alignment) such that the center of the lens LE is located in the vicinity of the center of the screen plate 105 (such that the position of the optical center of the lens LE is located within the dot indexes of the index plate 114). An image of the lens LE and index images of the index plate 114 are projected onto the screen plate 15, and the entire image of the lens LE is picked up by the second CCD 117*b*. Its image LE' is displayed on the screen of the monitor 102 (see FIG. 13). In addition, the index images projected onto the screen plate 115 is picked up by the first CCD 117*a*. That image signal is inputted to the processing unit 134, and the control unit 130 continuously obtains information on the displacement of the position of the optical center from the reference axis L and information on the direction of the cylinder axis on the basis of information on the coordinate positions of the dot index images detected by the processing unit 134.

Figure 13:
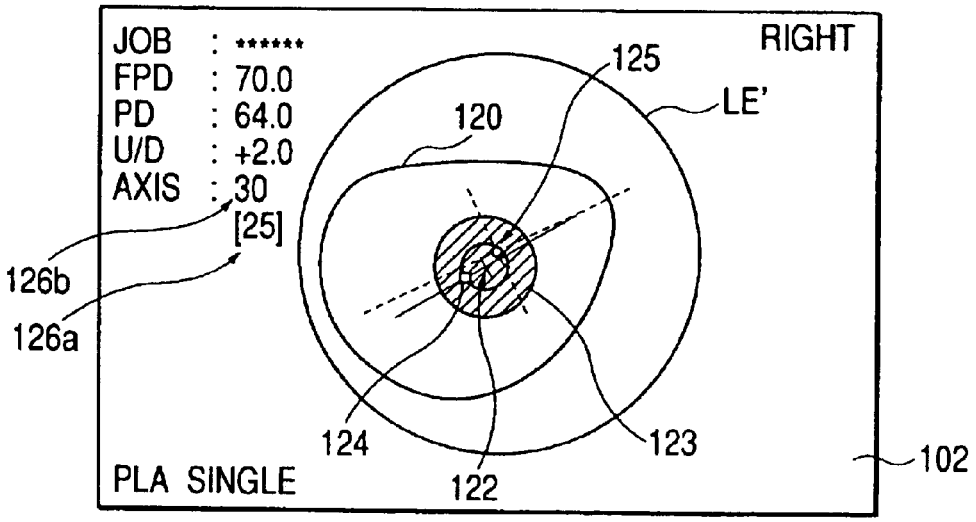
FIG. 13 is a diagram illustrating an example of the monitor in the unifocal lens.

After these items of information are obtained, a cross mark 125 showing the position of the optical center of the lens LE is displayed by the circuit 136, as shown in FIG. 13. This mark 125 is displayed with its center conforming to the position of the optical center of the lens LE and with its long axis inclined in such a manner as to conform to the information on the direction of the cylinder axis detected. Further, when the information on the displacement of the position of the optical center is obtained, the intended lens shape Figure 120 comes to be displayed by using the position of the optical center as the reference. Namely, the intended lens shape Figure 120 is displayed such that the position of optical center of the lens LE and the position of the optical center of the intended lens which is determined by the input of the layout data are aligned with each other. Since this intended lens shape Figure 120 is displayed by being superposed on the lens image LE', by observing the two images at this stage the operator is able to instantly determine whether or not the lens diameter is lacking for processing. If the lens LE is moved, the center of the cross mark 125 also moves on the screen, and the intended lens shape Figure 120 also moves correspondingly.

If there is no problem with the lens diameter, the alignment of the lens LE is effected in the following manner while further observing the display on the screen. First, in the alignment of the position of the optical center with respect to the cup attaching center, the lens LE is moved in such a manner that the cup shape Figure 123 is kept within the intended lens shape Figure 120. In this state, the cup 106 can be attached.

When the cup 106 is attached to the lens LE, the cup center and the position of the optical center are generally made to align with each other, but with this apparatus accurate alignment is not necessarily required. The reason for this is that since information on the displacement of the position of the optical center from the cup attaching center is already known as described above, that displacement is corrected at the time of processing on the processing apparatus 138 side. Incidentally, the reason that the alignment is effected so that the cup shape Figure 123 is kept within the intended lens shape Figure 120 is to ensure that the cup 106 attached at the time of processing will not cause processing interference. Instead of observing the intended lens shape Figure 120 and the cup'shape Figure 123, a region where the position of the optical center should be located to avoid processing interference may be determined from various data by using the cup attaching center as a reference, and this region may be displayed as alignment information. In the alignment, the center of the cross mark 125 is made to fall within that region.

In the alignment in the direction of the cylinder axis, the lens LE is rotated in such a manner that the inclination of the long axis of the cross mark 122 and the inclination of the long axis of the cross mark 125 are aligned with each other as much as possible. As for the direction of the cylinder axis as well, since the amount of offset (displacement) with respect to the inputted cylinder axis can be known, that amount of offset (displacement) is corrected at the time of processing on the processing apparatus 138 side. In this embodiment, however, since the intended lens shape Figure 120 is not displayed in correspondence with the detected cylinder axis, if the offset (displacement) of the direction of the cylinder axis is large, there are cases where it is impossible to accurately ascertain the processing interference due to the aforementioned positional relationship between the intended lens shape Figure 120 and the cup shape Figure 123. If the cup shape Figure 123 can be sufficiently kept within the intended lens shape Figure 120, the accurate alignment operation of the direction of the cylinder axis is unnecessary.

It should be noted that, the intended lens shape Figure 120 may be displayed after being rotated by using the position of the optical center as a reference on the basis of the information on the detected direction of the cylinder axis. This makes it possible to accurately confirm the processing interference due to the positional relationship between the intended lens shape Figure 120 and the cup shape Figure 123 without performing the alignment operation of the direction of the cylinder axis.

After the alignment has been made, a BLOCK key 103*i* is turned ON. The control unit 130 drives the motor 131 to rotate the shaft 107*a* so as to allow the cup 106 mounted in advance on the attaching portion 107 to arrive at the reference axis L. The control unit 130 then drives the motor 132 to lower the cup 106 and allows the lens LE to be sucked by the cup 106. At the same time, the information on the displacement of the position of the optical center and the information on the direction of the cylinder axis are stored in the memory 140. After the cup for the right eye lens has been attached, a switch between the right and left eye lenses is effected by pressing an R/L key 103*k* to attach the cup for the left eye lens. Incidentally, when the cup is attached, a job number is inputted in advance by operating a JOB key 103*m* and the ten-key pad 103*d*, thereby allowing the lens data stored in the memory 140 to be managed by the job numbers.

After the attachment of the cup 106, the stored data is read out by designating a job number, and is inputted to the processing apparatus 138. As the processing apparatus 138, it is possible to use the one disclosed in U.S. Pat. No. 5,716,256. In the processing apparatus 138, if the job number is inputted by an input section 138*b* (e.g., a work slip with a bar code attached in correspondence with the job number is read by a bar-code scanner), the lens data corresponding to the job number is read from the cup attaching apparatus body 101, and is inputted. In the processing apparatus 138, the lens LE is chucked by two lens rotating shafts 138*c*, and a moving mechanism 138*e* for changing the distance between a rotating shaft of a grinding wheel 138*d* for processing and the lens rotating shaft 138*c* is operated so as to perform processing on the basis of the inputted data. At this time, with respect to the processing data obtained from the shape data of the eyeglasses frame and layout data, a control unit 138*a* of the processing apparatus 138 obtains new processing data by effecting the coordinate transformation of the displacement of the position of the optical center and the offset (displacement) of the direction of the cylinder axis when the cup 106 is attached, and the control unit 138*a* controls the processing on the basis of it. Thus, even if the cup 106 is attached to an arbitrary position, since that position is corrected, the lens LE is processed without an error. Accordingly, since accurate alignment is not required for the cup attaching apparatus body 101, even a person unskilled in the operation can speedily perform the operation very easily, and the cup attaching operation can be conducted efficiently.

Although a description has been given above of the case in which the cup 106 is attached to an arbitrary position, it is also possible to easily effect the optical-center layout in which the cup 106 is attached to the position of the optical center of the lens LE as well as the frame-center layout in which the cup 106 is attached to the position of the geometric center of each eyeglasses frame portion.

In the case of the optical-center layout, the lens LE is moved so that the center of the cross mark 125 displayed on the screen is aligned with the center of the cross mark 122. In the case of the frame-center layout, the lens LE is moved so that the center mark 124 showing the geometric center of the eyeglasses frame is aligned with the center of the cross mark 122. The alignment of the direction of the cylinder axis is effected by rotating the lens LE such that, in both cases, the numerical value 126*a* displayed on the screen agrees with the numerical value 126*b* of the inputted angle thereabove, or the long axis of the cross mark 125 assumes the same inclination as that of the long axis of the cross mark 122.

In these layouts as well, the confirmation of processability concerning the lens diameter on the basis of the lens image LE' and the intended lens shape Figure 120, as well as the confirmation of processing interference on the basis of the cup shape Figure 123 and the intended lens shape Figure 120, can be performed simply.

Figure 16:
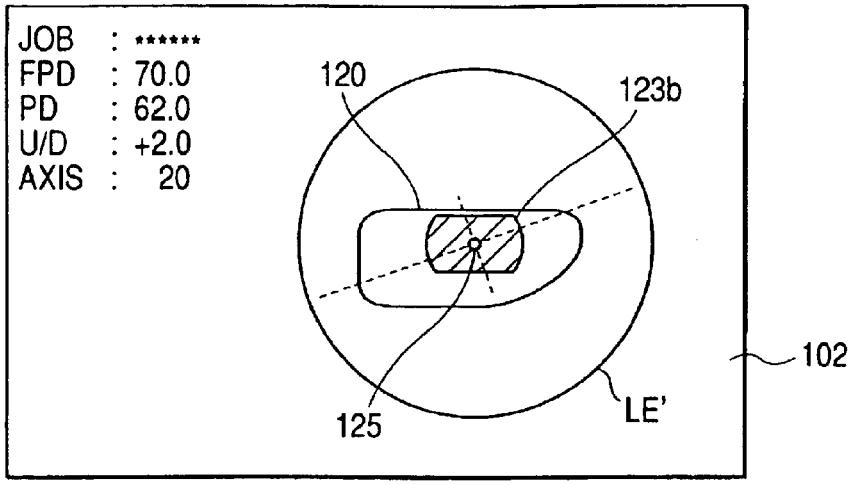
FIG. 16 is a diagram illustrating an example of the monitor, which is displayed in a case where a cup shape figure is changed to a crab-eye shape figure.

When the lens LE is processed by narrowing the vertical length of the lens, i.e., when the lens LE is processed into the so-called crab eye lens or lens for "granny's glasses" (which is often used for eyeglasses designed especially for near use), since a cup designed especially for the crab eye lens is attached to avoid processing interference, in such a case it suffices if the shape of the cup shape Figure 123 (123*b*) is displayed in the crab eye shape, see FIG. 16.

<Progressive Multifocal Lens>

The progressive multifocal lens mode is selected by the TYPE key 103*a*, and layout data for the progressive multifocal lens is inputted. Since the progressive multifocal lens is provided with the layout marks indicating such as the eyepoint for far use and the horizontal direction, the layout mark images together with the lens image are clearly projected onto the screen plate 105, and these images are picked up by the second CCD 117*b* and are displayed on the monitor 102.

Figure 14:
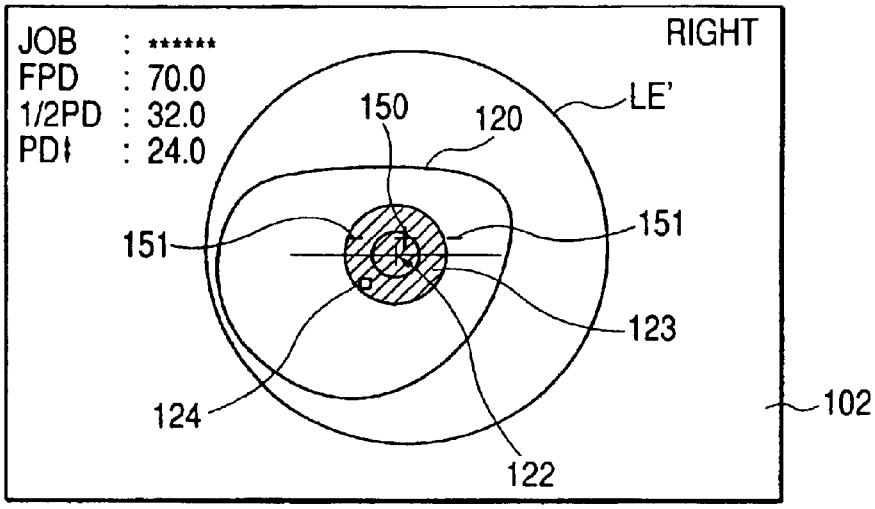
FIG. 14 is a diagram illustrating an example of the monitor in a multifocal lens.

FIG. 14 shows an example of the screen at this time, and the intended lens shape Figure 120 in this mode is displayed after being moved on the basis of the inputted layout data by using the center of the cup shape Figure 123 (cup attaching center) as a reference. Reference numeral 150 denotes an image of the eyepoint mark for far use, and numeral 151 denotes an image of the horizontal line mark. Alignment is effected by moving the lens LE in such a manner that these images are superposed on the cross mark 122. After completing the alignment, the operator confirms the processability concerning the lens diameter through comparison of the lens image LE' with the intended lens shape Figure 120, confirms processing interference through comparison of the cup shape Figure 123 and the intended lens shape Figure 120, and then presses the BLOCK key 103*i* to attach the cup 106.

<Bifocal Lens>

Figure 15:
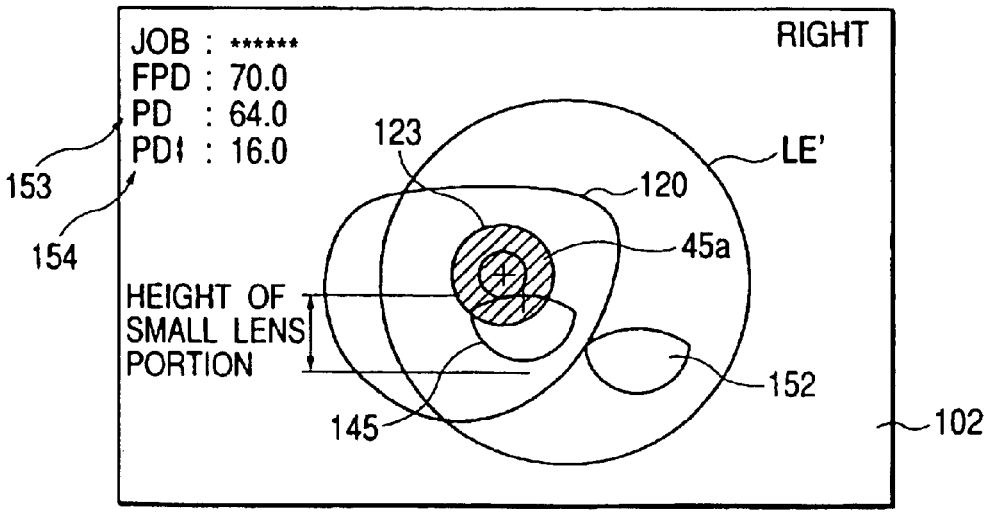
FIG. 15 is a diagram illustrating an example of the monitor in the bifocal lens.

The bifocal lens mode is selected by the TYPE key 103*a*. As shown in FIG. 15, a small lens portion layout mark 145 is displayed at a predetermined position on the screen with respect to the cup attaching center (e.g., in the case of the right eye use, a small lens upper side center mark 145*a* is located at a position offset about 5 mm toward the right side and the lower side, respectively, with respect to the cup attaching center) The layout data is inputted by operating the panel switch 103 in accordance with the input items displayed on the left-hand side. In an item 153, the pupillary distance for near use is entered. In an item 154, the distance from the center of the upper line of the small lens portion to the bottom side of the lens immediately therebelow (that is to say, the height of the small lens portion) is entered. As a result, the display position of the intended lens shape Figure 120 is determined.

The alignment of the bifocal lens is performed as follows. Although the small lens portion image of the bifocal lens is shot only unclearly even if the lens is shot directly, if the lens is illuminated by parallel rays of light, the small lens portion image of the bifocal lens is clearly projected onto the screen plate 105. As this image is picked up by the second CCD 117*b*, a clear small lens portion image is displayed on the monitor 102. The operator moves the lens LE such that a displayed small lens portion image 152 is superposed on the mark 145, and such that an upper center of the small lens portion image 152 is superposed on the small lens upper side center mark 145*a* of the mark 145. This completes the alignment, so that the operator confirms the processability concerning the lens diameter through comparison of the lens image LE' with the intended lens shape Figure 120, confirms processing interference through comparison of the cup shape Figure 123 and the intended lens shape Figure 120, and then presses the BLOCK key 103*i* to attach the cup 106.

Figure 17:
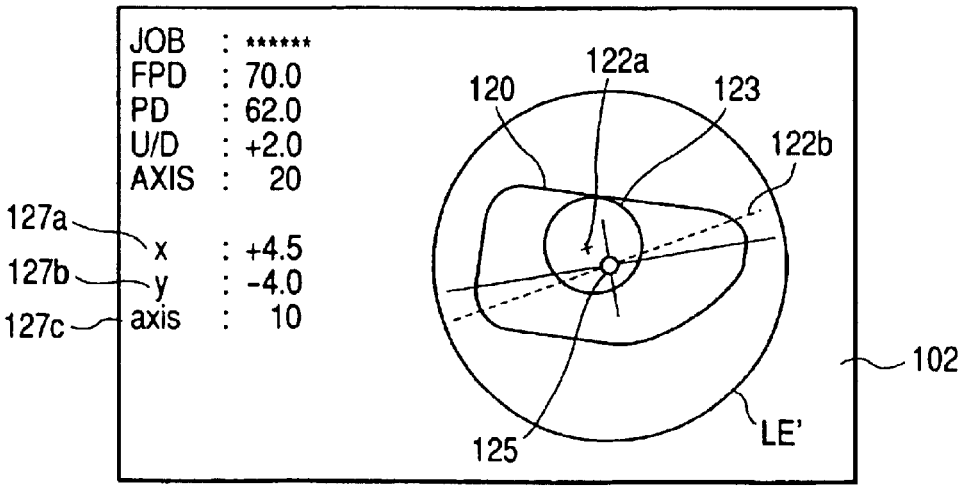
FIG. 17 is a diagram illustrating a modified example of the monitor, which is displayed for the unifocal lens.

FIG. 17 shows a modified example of the monitor, which is displayed for the unifocal lens. In addition to the intended lens shape figure (the target lens shape figure) 120, the cup shape Figure 123 indicating the shape of the cup 106 to be attached to the lens LE is displayed in red color on the screen of the monitor 2 by using as the center the position on the screen corresponding to the reference axis L which is the center of cup attachment. In a state prior to the mounting of the lens LE, the intended lens shape Figure 120 is displayed in such a state that the layout optical center position is aligned with the center of the cup shape Figure 123. In addition, if the data on the angle (direction) of the astigmatic axis is inputted, an AXIS mark 122*b* inclined to correspond to the inputted angle (direction) is displayed in red color using the center of the cup shape Figure 123 as a reference.

When the information on the offset (displacement) of the position of the optical center of the lens LE with respect to the reference axis L as well as the information on the direction of the cylinder axis of the lens LE with respect to the reference axis L are obtained, a cross mark 125 indicating the position of the optical center of the lens LE is displayed in white color. This cross mark 125 is displayed such that the center of a circle "O" depicted in the center conforms to the detected position of the optical center of the lens LE, and such that the long axis of the cross mark 125 is inclined to conform to the detected direction of the cylinder axis. Further, the AXIS mark 122*b* indicating the inputted direction (the inputted angle) of the astigmatic axis is displayed with the center of the cross mark 125 (the position of the optical center of the lens LE) as a reference.

In addition, the intended lens shape Figure 120 is displayed such that the position of the layout optical center position is aligned with the detected position of the optical center of the lens LE, and such that the inputted direction (the inputted angle) of the astigmatic axis conforms to the detected direction (the detected angle) of the cylinder axis of the lens LE. Further, the intended lens shape Figure 120 is displayed by being superposed on the lens image LE'.

The alignment operation for attaching the cup 106 at the position of the optical center of the lens LE is performed as follows. Since a reference mark 122*a* indicating a cup attachment center (the reference axis L) is displayed in red color at the center of the cup shape Figure 123, the operator moves the lens LE so that the center of the reference mark 122*a* and the center of the cross mark 125 are aligned. As for the alignment of the direction of the cylinder axis, the lens LE is rotated so that the long axis of the cross mark 125 conforms to the direction of the AXIS mark 122*b*. At this time, since the AXIS mark 122*b* serving as a target for alignment is displayed with the detected position of the optical center of the lens LE as a reference, the alignment of the direction of the cylinder axis can be concurrently effected while performing the alignment of the position of the optical center. In addition, since the alignment of the position of the optical center can be effected after substantially completing the alignment of the direction of the cylinder axis, the degree of offset of the center accompanying the rotational movement of the lens LE is reduced, so that the efficiency in the alignment operation can be achieved.

It should be noted that information on the displacement (offset) of the position of the optical center of the lens LE with respect to the reference axis L is displayed in display items 127*a* and 127*b* on the left-hand side of the monitor 102 as numerical values of distance (unit:mm) by x and y. Further, the detected angle (the detected direction) of the cylinder axis is numerically displayed in a display item 127*c*. Through these displays as well, the operator is able to conduct the alignment.

Instead of using the lens supporting portions 104 and the index plate 114, a lens mounting base with the lens supporting portions and the index plate formed integrally thereon may be attached to the screen plate 105. Then, if this lens mounting base is made rotatable about the reference axis L, the lens LE can be rotated by rotating the lens mounting base even if the lens LE is not rotated while being manually held.

The cup attaching portion 7 may be so arranged that the shaft 7*a* is moved linearly in stead of being rotated. Further, the shaft 7*a* may project not from the lower side of the main body 1, but from the upper side thereof.

As described above, in accordance with the present invention, alignment for attaching a cup in the unifocal lens, the multifocal lens or the like which are not provided with marked points can be performed easily. With respect to the unifocal lense, in particular, even a person unskilled in the operation is able to speedily perform the alignment operation very easily, and is able to reduce processing errors. For this reason, the cup attaching operation can be conducted efficiently.

In addition, the confirmation of processability concerning the lens diameter and the confirmation of processing interference at the cup attaching portion can be performed simply.

What is claimed is:

1. A cup attaching apparatus comprising:

attaching means having a reference axis to attach a cup as a processing jig to a subject lens along the reference axis;

illuminating means for illuminating the lens and an index plate having an index of a predetermined pattern by means of rays of light shaped into a diameter larger than a diameter of the lens;

a screen for projecting an image of the lens and an image of the index which are formed by said illuminating means;

imaging means for picking up the images projected onto said screen;

optical-center detecting means for obtaining a position of an optical center of the lens by processing the index image picked up by said imaging means; and display means for displaying in a superposed manner information on the position of the optical center obtained by said optical-center detecting means and the lens image picked up by said imaging means, wherein attachment of said cup to the lens is effected by alignment while observing display by said display means; and wherein the cup attaching apparatus further comprises cylinder-axis detecting means for obtaining a direction of a cylinder axis of the lens by processing the index image picked up by said imaging means; and wherein said display means also displays information on the direction of the cylinder axis obtained by said cylinder-axis detecting means.

2. The cup attaching apparatus according to claim 1, further comprising:

input means for inputting data on an angle of an astigmatic axis obtained by prescription, wherein said display means includes forming means for forming on the display a reference mark having a predetermined positional relationship with the reference axis at a relative position of the position of the optical center obtained by the optical-center detecting means, and an astigmatic axis mark indicating a direction of the astigmatic axis inputted by said input means.

3. The cup attaching apparatus according to claim 2, wherein said forming means forms on the display an optical center mark indicating the obtained position of the optical center, a cylinder axis mark indicating the obtained direction of the cylinder axis based on the optical center mark, and the astigmatic mark based on the reference mark or the optical center mark.

4. A cup attaching apparatus comprising:

attaching means having a reference axis to attach a cup as a processing jig to a subject lens along the reference axis;

illuminating means for illuminating the lens and an index plate having an index of a predetermined pattern by means of rays of light shaped into a diameter larger than a diameter of the lens;

a screen for protecting an image of the lens and an image of the index which are formed by said illuminating means;

imaging means for picking up the images projected onto said screen;

optical-center detecting means for obtaining a position of an optical center of the lens by processing the index image picked up by said imaging means; and display means for displaying in a superposed manner information on the position of the optical center obtained by said optical-center detecting means and the lens image picked up by said imaging means, wherein attachment of said cup to the lens is effected by alignment while observing display by said display means; and wherein said display means includes forming means for forming on the display a reference mark having a predetermined positional relationship with the reference axis at a relative position of the position of the optical center obtained by said optical-center detecting means.

5. The cup attaching apparatus according to claim 4, further comprising:

selecting means for selecting a type of the lens, wherein when a progressive multifocal lens is selected by said selecting means, said display means also displays an image of a layout mark of the progressive multifocal lens, and the alignment is effected while observing the image of the layout mark and the reference mark on the display.

6. A cup attaching apparatus comprising:

attaching means having a reference axis to attach a cup as a processing jig to a subject lens along the reference axis;

illuminating means for illuminating the lens and an index plate having an index of a predetermined pattern by means of rays of light shaped into a diameter larger than a diameter of the lens;

a screen for protecting an image of the lens and an image of the index which are formed by said illuminating means;

imaging means for picking up the images projected onto said screen;

optical-center detecting means for obtaining a position of an optical center of the lens by processing the index image picked un by said imaging means; and display means for displaying in a superposed manner information on the position of the optical center obtained by said optical-center detecting means and the lens image picked up by said imaging means, wherein attachment of said cup to the lens is effected by alignment while observing display by said display means; and wherein the cup attaching apparatus further comprises input means for inputting data on a shape of an eyeglasses frame into which the lens is fitted and data on layout of the lens with respect to the eyeglasses frame, wherein said display means includes forming means for forming on the display a frame shape figure based on the data inputted by said input means.

7. The cup attaching apparatus according to claim 6, wherein said forming means forms the frame shape figure so that the reference axis or the obtained position of the optical center is aligned with a layout position of the optical center.

8. The cup attaching apparatus according to claim 6, further comprising:

selecting means for selecting a type of the lens, wherein said forming means further forms on the display a small lens portion mark for positioning a small lens portion of a bifocal lens on the basis of the data inputted by said input means when the bifocal lens is selected by said selecting means, alignment is effected while observing the small lens portion mark and an image of the small lens portion on the display.

9. The cup attaching apparatus according to claim 6, further comprising:

storage means for storing a cup shape, wherein said forming means forms, on the display based on the stored cup shape, a cup shape figure a center position of which has a predetermined positional relationship with the reference axis.

10. The cup attaching apparatus according to claim 6, further comprising:

selecting means for selecting an optical center mode for attaching said cup at the position of the optical center of the lens and a frame center mode for attaching said cup at a position of a geometric center of the eyeglasses frame, wherein said forming means further forms on the display a reference mark indicating a position of an optical center laid out by input by said input means, when the optical center mode has been selected by said selecting means, said forming means forms the frame shape figure laid out with the reference axis and the reference mark aligned with each other, and when the frame center mode has been selected by said selecting means, said forming means forms the frame shape figure laid out with the reference axis and the position of the geometric center of the eyeglasses frame aligned with each other.

11. The cup attaching apparatus according to claim 1, further comprising:

changing means for changing a position at which said screen is disposed on an optical axis of projection.

12. The cup attaching apparatus according to claim 1, wherein the index of the predetermined pattern includes an index by dots arranged in the form of a grid.

13. A cup attaching apparatus comprising:

attaching means having a reference axis to attach a cup as a processing jig to a subject lens along the reference axis;

illuminating means for illuminating the lens and an index plate having an index of a predetermined pattern;

index detecting means for detecting an image of the index formed by said illuminating means;

optical-center detecting means for obtaining a position of an optical center of the lens with respect to the reference axis on the basis of a result of detection by said index detecting means; and position storing means for storing information on the position of the optical center obtained by said optical-center detecting means when said cup is attached to the lens by said attaching means, wherein the information on the position of the optical center stored by said position storing means is used as information on correction at the time of processing by an eyeglass lens processing apparatus.

14. The cup attaching apparatus according to claim 13, wherein the index of the predetermined pattern includes dot indexes arranged grided.

15. The cup attaching apparatus according to claim 13, further comprising:

shape storing means for storing a shape of the cup which is attached to the lens;

input means for inputting data on a shape of an eyeglasses frame into which the lens is fitted and data on layout of the lens with respect to the eyeglasses frame; and display means for displaying alignment information for avoiding processing interference, on the basis of the cup shape stored by said shape storing means, the frame shape based on the data inputted by said input means, and a relative position of the optical center obtained by said optical-center detecting means with respect to the reference axis.

16. The cup attaching apparatus according to claim 15, wherein said display means displays the cup shape in such a manner as to have a predetermined positional relationship with the reference axis, and displays the frame shape such that a position of an optical center laid out by input by said input means is located at the position of the optical center obtained by said optical-center detecting means.

17. The cup attaching apparatus according to claim 16, wherein said display means includes forming means for forming on display a reference mark for alignment having a predetermined positional relationship with the reference axis and a center mark indicating a position of the optical center or a position of a frame center of the frame shape.

18. The cup attaching apparatus according to claim 15, wherein said display means displays a region for aligning the position of the optical center obtained by said optical-center detecting means with respect to the reference axis.

19. The cup attaching apparatus according to claim 15, wherein said display means displays a region for aligning the position of the optical center obtained by said optical-center detecting means with respect to the reference axis, and includes forming means for forming on display a reference mark for alignment having a predetermined positional relationship with the reference axis and a center mark indicating a position of the optical center or a position of a frame center of the frame shape.

20. The cup attaching apparatus according to claim 13, further comprising:

cylinder-axis detecting means for obtaining a direction of a cylinder axis of the lens on the basis of the result of detection by said index detecting means;

input means for inputting data on an angle of an astigmatic axis obtained by prescription;

displacement detecting means for obtaining information on displacement in the direction of the cylinder axis obtained by said cylinder-axis detecting means with respect to a direction of the astigmatic axis inputted by said input means; and displacement storing means for storing the displacement information obtained by said displacement detecting means when the cup is attached to the lens by said attaching means, wherein the displacement information stored by said displacement storing means is also used as information on correction at the time of processing by said eyeglass lens processing apparatus.

21. The cup attaching apparatus according to claim 13, further comprising:

cylinder-axis detecting means for obtaining a direction of a cylinder axis of the lens on the basis of the result of detection by said index detecting means;

input means for inputting data on an angle of an astigmatic axis obtained by prescription; and display means for displaying information on the direction of the cylinder axis obtained by said cylinder-axis detecting means and information on a direction of the astigmatic axis inputted by said input means, wherein alignment in the direction of the cylinder axis is effected while observing display by said display means.

22. The cup attaching apparatus according to claim 13, further comprising:

a screen for projecting an image of the lens formed by said illuminating means;

imaging means for picking up an entire image of the lens projected onto said screen;

input means for inputting data on a shape of an eyeglasses frame into which the lens is fitted and data on layout of the lens with respect to the eyeglasses frame;

display means for displaying the lens image picked up by said imaging means; and forming means for forming on display by said display means a frame shape figure based on the data inputted by said input means such that a position of an optical center laid out by input by said input means is located at the position of the optical center obtained by said optical-center detecting means.

23. The cup attaching apparatus according to claim 13, further comprising:

a screen for projecting an image of the lens formed by said illuminating means;

imaging means for picking up an entire image of the lens projected onto said screen;

display means for displaying the lens image picked up by said imaging means;

forming means for forming on display by said display means a reference mark having a predetermined positional relationship with the reference axis; and selecting means for selecting a type of the lens, wherein when a progressive multifocal lens is selected by said selecting means, an image of a layout mark of the progressive multifocal lens is displayed on the display, and alignment is effected while observing the layout mark image and the reference mark on the display.

24. The cup attaching apparatus according to claim 13, further comprising:

a screen for projecting an image of the lens formed by said illuminating means;

imaging means for picking up an entire image of the lens projected onto said screen;

display means for displaying the lens image picked up by said imaging means;

input means for inputting data on layout of the lens with respect to an eyeglasses frame;

selecting means for selecting a type of the lens; and forming means for forming on display by said display means a small lens portion mark for positioning a small lens portion of a bifocal lens on the basis of the data inputted by said input means when the bifocal lens is selected by said selecting means, wherein alignment is effected while observing the small lens portion mark and an image of the small lens portion on the display.

25. A cup attaching apparatus for attaching a cup onto an eyeglass lens, the cup being adapted to fix the eyeglass lens onto a lens rotating shaft of a lens processing apparatus, the cup attaching apparatus comprising:

cup attaching means for moving the cup to the lens placed at a predetermined position, and attaching the cup onto the lens;

detecting means, provided with a measurement optical system having a measurement light source, a measurement index plate and a photoelectric detector, for detecting a position of an optical center of the lens and a direction of a cylinder axis of the lens;

cylinder axis instructing means for instructing a direction of the cylinder axis of the lens; and display means for displaying a reference mark indicating a predetermined reference position, and an optical center mark and a cylinder axis mark both based on a result of detection by the detecting means, the optical center mark indicating the position of the optical center of the lens with respect to the predetermined reference position, the cylinder axis mark indicating the direction of the cylinder axis of the lens with respect to the instructed direction of the cylinder axis.

26. The cup attaching apparatus according to claim 25, wherein the predetermined reference position includes a center position about which the cup is to be attached.

27. The cup attaching apparatus according to claim 25, wherein the measurement index plate has an index by dots arranged in the form of a grid.

28. The cup attaching apparatus according to claim 27, wherein the measurement optical system further includes a screen onto which an image of the index is projected, and the photoelectric detector includes a two-dimensional image pick-up element for picking-up the image of the index projected onto the screen.

29. The cup attaching apparatus according to claim 25, further comprising:

lens shape inputting means for inputting an outer circumferential shape of the lens, wherein the display means displays the inputted outer circumferential shape of the lens based on the optical center mark.

30. The cup attaching apparatus according to claim 29, wherein the lens shape inputting means includes image pick-up means for picking up an entire image of the lens placed at the predetermined position, and the display means displays the picked-up image of the lens.

31. The cup attaching apparatus according to claim 25, wherein the cylinder axis instructing means includes axis angle inputting means for inputting an angle of an astigmatic axis indicated by a prescription.

32. The cup attaching apparatus according to claim 25, wherein the display means displays the cylinder axis mark based on the optical center mark, and the display means displays a second cylinder axis mark indicating the instructed direction of the cylinder axis of the lens based on the reference mark or the optical center mark.

33. The cup attaching apparatus according to claim 25, further comprising:

data input means for inputting data on a shape of an eyeglass frame to which the lens is to be fitted, and data on a layout of the lens with respect to the eyeglass frame, wherein the display means displays a frame shape so that a center of the reference mark or a center of the optical center mark is aligned with a layout position of the optical center.

34. The cup attaching apparatus according to claim 33, further comprising:

cup shape storing means for storing a cup shape, wherein the display means further displays a cup shape figure centered with respect to the reference mark based on the stored cup shape.

35. The cup attaching apparatus according to claim 25, further comprising:

judging means for judging at least one of whether the position of the optical center of the lens falls within a predetermined first range with respect to the predetermined reference position and whether the direction of the cylinder axis of the lens falls within a predetermined second range with respect to the instructed direction of the cylinder axis; and notifying means for notifying a result of judgement by the judging means.

36. The cup attaching apparatus according to claim 25, further comprising:

judging means for judging at least one of whether the position of the optical center of the lens falls within a predetermined first range with respect to the predetermined reference position and whether the direction of the cylinder axis of the lens falls within a predetermined second range with respect to the instructed direction of the cylinder axis; and control means for controlling operation of the cup attaching means based on a result of judgement by the judging means.

37. The cup attaching apparatus according to claim 25, further comprising:

positional information storing means for storing an offset amount of the position of the optical center of the lens with respect to the predetermined reference position, and an offset amount of the direction of the cylinder axis of the lens with respect to the instructed direction of the cylinder axis; and transmitting means for transmitting the stored offset amounts to the lens processing apparatus.

38. The cup attaching apparatus according to claim 13, wherein said optical-center detecting means obtains information on displacement of the position of the optical center with respect to the reference axis, said position storing means stores the displacement information obtained by said optical-center detecting means when the cup is attached to the lens, and the displacement information stored by said position storing means is used as the information on correction.

39. A cup attaching apparatus comprising:

an attaching device having a reference axis to attach a cup as a processing jig to a subject lens along the reference axis;

a light source that illuminates the lens and an index plate having an index of a predetermined pattern by rays of light shaped into a diameter larger than a diameter of the lens;

a screen for projecting an image of the lens and an image of the index which are formed by said light source;

an imaging device that picks up the images projected onto said screen;

an optical-center detector that obtains a position of an optical center of the lens by processing the index image picked up by said imaging device; and a display unit that displays in a superposed manner information on the position of the optical center obtained by said optical-center detector and the lens image picked up by said imaging device;

wherein attachment of said cup to the lens is effected by alignment while observing the display unit; and wherein the cup attaching apparatus further comprises a cylinder-axis detector that obtains a direction of a cylinder axis of the lens by processing the index image picked up by said imaging device; and wherein said display unit also displays information on the direction of the cylinder axis obtained by said cylinder-axis detector.

40. A cup attaching apparatus comprising:

an attaching device having a reference axis to attach a cup as a processing jig to a subject lens along the reference axis;

a light source that illuminates the lens and an index plate having an index of a predetermined pattern by rays of light shaped into a diameter larger than a diameter of the lens;

a screen for projecting an image of the lens and an image of the index which are formed by said light source;

an imaging device that picks up the images projected onto said screen;

an optical-center detector that obtains a position of an optical center of the lens by processing the index image picked up by said imaging means; and a display unit that displays in a superposed manner information on the position of the optical center obtained by said optical-center detector and the lens image picked up by said imaging device;

wherein attachment of said cup to the lens is effected by alignment while observing the display unit; and wherein said display unit forms a reference mark having a predetermined positional relationship with the reference axis at a relative position of the position of the optical center obtained by said optical-center detector.

41. A cup attaching apparatus comprising:

an attaching device having a reference axis to attach a cup as a processing jig to a subject lens along the reference axis;

a light source that illuminates the lens and an index plate having an index of a predetermined pattern by rays of light shaped into a diameter larger than a diameter of the lens;

a screen for projecting an image of the lens and an image of the index which are formed by said light source;

an imaging device that picks up the images projected onto said screen;

an optical-center detector that obtains a position of an optical center of the lens by processing the index image picked up by said imaging means; and a display unit that displays in a superposed manner information on the position of the optical center obtained by said optical-center detector and the lens image picked up by said imaging device;

wherein attachment of said cup to the lens is effected by alignment while observing the display unit; and wherein the cup attaching apparatus further comprises an input device to input data on a shape of an eyeglasses frame into which the lens is fitted and data on layout of the lens with respect to the eyeglasses frame; and wherein said display unit forms a frame shape figure based on the data inputted by said input device.

42. A cup attaching apparatus comprising:

an attaching device having a reference axis to attach a cup as a processing jig to a subject lens along the reference axis;

a light source that illuminates the lens and an index plate having an index of a predetermined pattern;

an index detector that detects an image of the index formed by said light source;

an optical-center detector that obtains a position of an optical center of the lens with respect to the reference axis on the basis of a result of detection by said index detector; and a position storage that stores information on the position of the optical center obtained by said optical-center detector when said cup is attached to the lens by said attaching device, wherein the information on the position of the optical center stored by said position storage is used as information on correction at the time of processing by an eyeglass lens processing apparatus.

43. A cup attaching apparatus for attaching a cup onto an eyeglass lens, the cup being adapted to fix the eyeglass lens onto a lens rotating shaft of a lens processing apparatus, the cup attaching apparatus comprising:

a cup attaching device that moves the cup to the lens placed at a predetermined position, and which attaches the cup onto the lens;

a detector, provided with a measurement optical system having a measurement light source, a measurement index plate and an photoelectric detector, that detects a position of an optical center of the lens and a direction of a cylinder axis of the lens;

a cylinder axis instructing device that instructs a direction of the cylinder axis of the lens; and a display that displays a reference mark indicating a predetermined reference position, and an optical center mark and a cylinder axis mark both based on a result of detection by the detector, the optical center mark indicating the position of the optical center of the lens with respect to the predetermined reference position, the cylinder axis mark indicating the direction of the cylinder axis of the lens with respect to the instructed direction of the cylinder axis.

* * * * *